United States Patent [19]

Busenhart et al.

[11] Patent Number: 4,817,896

[45] Date of Patent: Apr. 4, 1989

[54] THREAD-CATCHING DEVICE FOR WINDING MACHINES

[75] Inventors: Peter Busenhart; Heinz Oswald, both of Winterthur; Ruedi Schneeberger, Turbeuthal, all of Switzerland

[73] Assignee: Rieter Machine Works Ltd., Winterthur, Switzerland

[21] Appl. No.: 7,580

[22] Filed: Jan. 28, 1987

[30] Foreign Application Priority Data

Jan. 29, 1986 [GB] United Kingdom ..... 86 02179

[51] Int. Cl.[4] ..... B65H 54/02; B65H 65/00

[52] U.S. Cl. ..... 242/18 PW; 242/18 A

[58] Field of Search ..... 242/18 PW, 18 A, 18 R, 242/25 A, 25 R, 125.1, 125

[56] References Cited

U.S. PATENT DOCUMENTS

| | | | |
|---|---|---|---|
| 2,706,090 | 4/1955 | Blok | 242/18 A |
| 2,931,587 | 4/1960 | Pistor | 242/18 PW |
| 2,961,175 | 11/1960 | Detrick et al. | 242/25 A |
| 2,961,176 | 11/1960 | Swanson | 242/25 A |
| 2,961,177 | 11/1960 | Swanson | 242/25 A |
| 2,998,202 | 8/1961 | Keith et al. | 242/18 PW |
| 3,081,044 | 3/1963 | Keith | 242/18 R |
| 3,186,653 | 6/1965 | Stefaniszyn | 242/25 A |
| 3,208,680 | 9/1965 | Croisetiere | 242/25 A |
| 3,863,851 | 2/1975 | Sartori | 242/18 PW |
| 3,920,193 | 11/1975 | Gujer et al. | 242/18 A |
| 4,014,476 | 3/1977 | Turk et al. | 242/18 A X |
| 4,106,711 | 8/1978 | Oswald et al. | 242/18 PW X |
| 4,336,912 | 6/1982 | Greb | 242/18 PW X |
| 4,460,133 | 7/1984 | Turk et al. | 242/18 PW X |
| 4,477,034 | 10/1984 | Oswald | 242/18 PW |
| 4,482,099 | 11/1984 | Oswald et al. | 242/18 PW X |

FOREIGN PATENT DOCUMENTS

| | | |
|---|---|---|
| 1760458 | 2/1972 | Fed. Rep. of Germany . |
| 2200836 | 4/1974 | France . |
| 200341 | 1/1939 | Switzerland . |

*Primary Examiner*—Stanley N. Gilreath
*Attorney, Agent, or Firm*—Werner W. Kleeman

[57] ABSTRACT

A chuck is adapted to be cantilever-mounted for rotation about a longitudinal axis thereof in a winding machine for threads, such as synthetic plastics filament, glass fiber strands and so forth. The chuck comprises a chuck member and an element movable radially thereat between retracted and extended positions under the action of centrifugal force when the chuck is rotated about its longitudinal axis at or above a predeterminate operating speed in use. The element has a head portion which projects radially outwardly from the bobbin tube receiving surface of the chuck member of the chuck when the element is in its extended position, and is located inwardly of such bobbin tube receiving surface when the element is in its retracted position. The head portion either includes a thread-catching device adapted to receive and catch a thread to secure the thread to the chuck member for winding into a package thereon or is adapted to co-operate in use with a part carried by the chuck member in order to form such a thread-catching device.

18 Claims, 12 Drawing Sheets

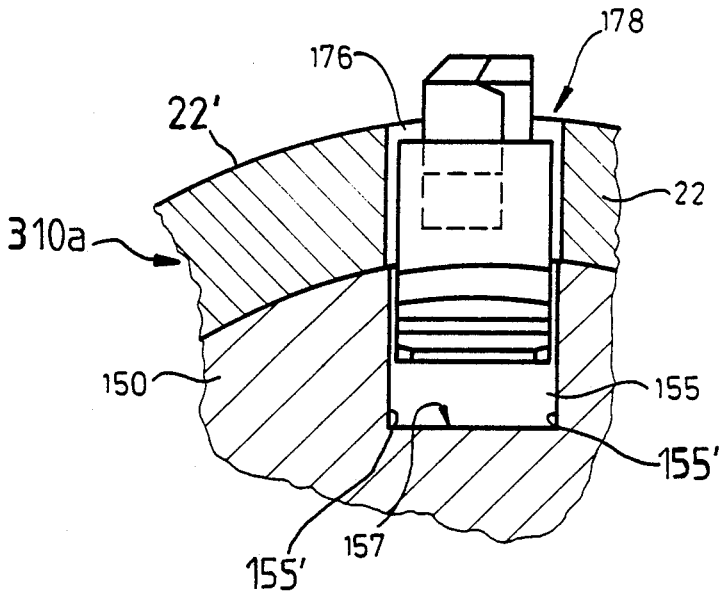
Fig. 2
Fig. 3
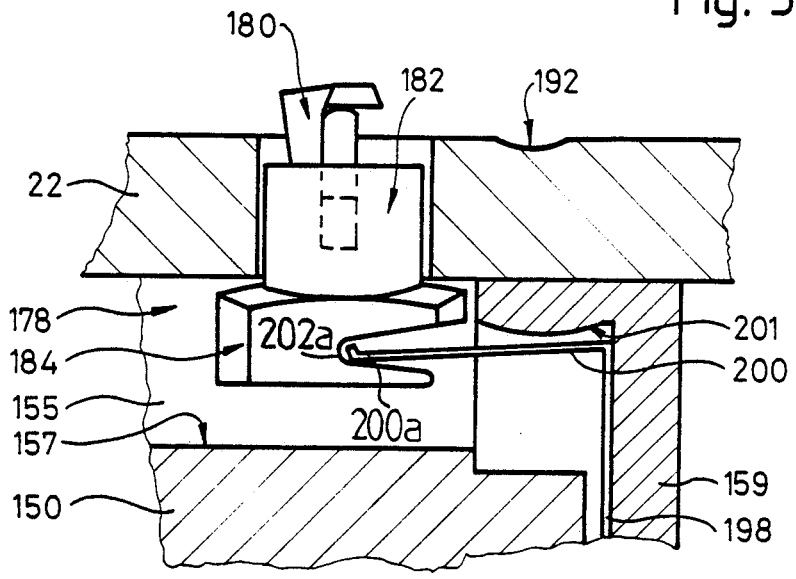

Fig. 12
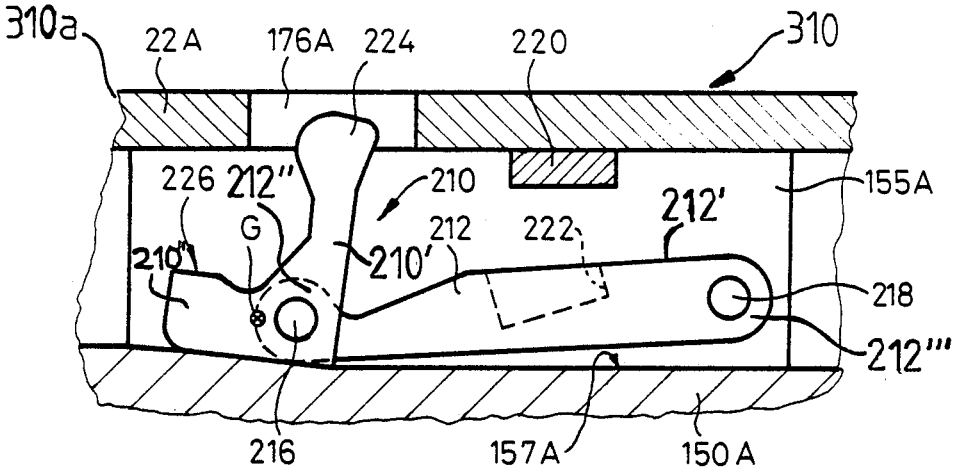
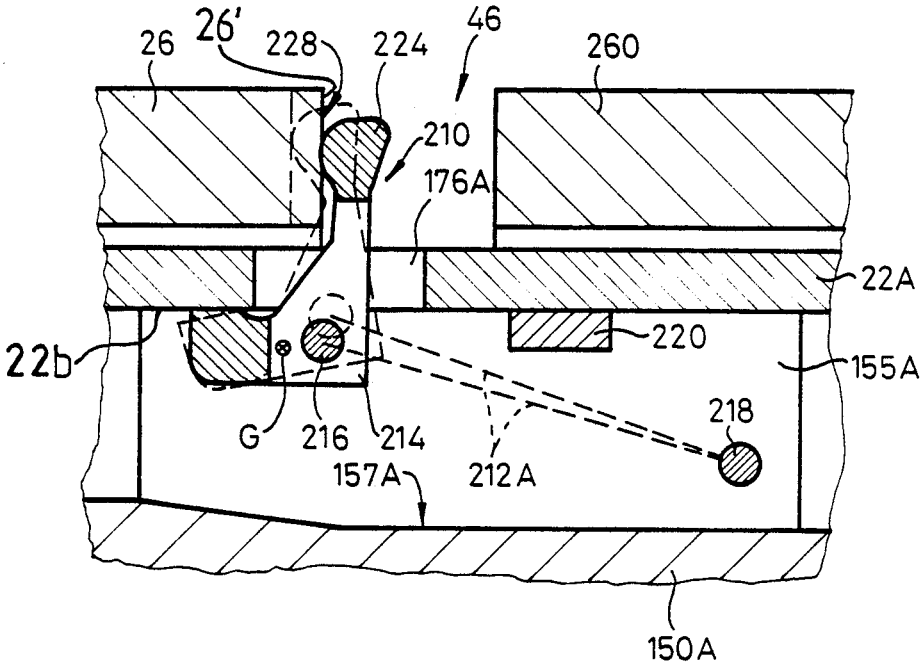
Fig. 13

THREAD-CATCHING DEVICE FOR WINDING MACHINES

BACKGROUND OF THE INVENTION

The present invention relates to thread-catching devices for high speed winding machines for threads and other filamentary materials, such as synthetic plastics filament, glass fiber strands and the like.

In this disclosure, the term "high speed" refers to linear thread speeds of 3000 m/min. and above, and especially to linear thread speeds above 5000 m/min.

The chuck or chuck structure (also called "spindle" or "mandrel") of a filament winder is frequently provided with a thread-catching device built into the chuck structure, for example as shown in U.S. Pat. No. 4,336,912, granted June 29, 1982, and listing as the inventor, Manfred Greb, entitled: "WINDING DEVICE", U.S. Pat. No. 4,460,133, granted July 17, 1984, and listing as the inventors, Herbert Turk et al, entitled: "WINDING DEVICE", and U.S. Pat. No. 4,106,711, granted Aug. 15, 1978, listing as the inventors, Heinz Oswald et al, entitled: "CHUCK FOR A TUBE ACTING AS A PACKAGE SUPPORT".

As shown by these patents, the chuck itself is commonly cantilevered-mounted, and bobbin tubes, on which thread packages are formed in use, can be placed on and removed from the chuck by moving them axially long the chuck from the free end thereof.

When the chuck or chuck structure is designed to carry a plurality of bobbin tubes simultaneously, for simultaneous formation of a corresponding plurality of thread packages, the thread-catching device either has to be built into the chuck or chuck structure radially inwardly of the outer cylindrical or bobbin tube receiving surface of the chuck, for example as shown in U.S. Pat. No. 4,014,476, granted Mar. 29, 1977, and listing as the inventors, Herbert Turk et al, entitled: "APPARATUS FOR WINDING CONTINUOUS THREADS OR YARNS" and U.S. Pat. No. 4,106,711, granted Aug. 15, 1978, and listing as the inventors, Heinz Oswald et al, entitled: "CHUCK FOR A TUBE ACTING AS A PACKAGE SUPPORT", or the device must be mounted on the chuck or chuck structure between neighboring bobbin tubes, for example as described in U.S. Pat. No. 4,477,034, granted Oct. 16, 1984, and listing as the inventor, Heinz Oswald, entitled: "THREAD CATCHING STRUCTURE" and U.S. Pat. No. 4,482,099, granted Nov. 13, 1984, and listing as the inventor, Heinz Oswald and entitled: "THREAD CATCHER RING".

Certain proposals have already been made regarding thread-catching devices movable on the chuck or chuck structure between retracted or radially inward positions enabling donning of bobbin tubes, and extended or radially outward or operating positions between neighboring bobbin tubes. For example European Patent Publication No. 470, published Feb. 7, 1979, and listing as the inventors Ernst Bauch, Bruno Eigenwald and Kurt Eschke, and U.S. Pat. No. 2,931,587, granted Apr. 5, 1960, and listing as the inventor, Christel Pistor, entitled: "SELF-ACTUATING TAILING GUIDE", cited in connection therewith, show thread catchers mounted on levers which can be pivoted by contact with the bobbin tubes themselves. Proposals have also been made for "snagging" devices movable from retracted to extended positions under the action of centrifugal force. Such a system is shown in U.S. Pat. No. 2,998,202, granted Aug. 29, 1961, and listing as the inventors, J. V. Keith et al, entitled: "INITIAL THREAD END SNAGGER", but is applicable only to a snagger at the free end of a cantilever-mounted chuck. Another is shown in U.S. Pat. No. 2,706,090, granted Apr. 12, 1955, and listing as the inventor, Hendrik Leendert Blok, entitled: "APPARATUS FOR THREAD TRANSFER", but this arrangement also is described only as applied to the end of a chuck.

Thread severing devices operated by centrifugal force have also been described in German Published Pat. No. 1,760,458, published Feb. 10, 1972 and listing as the inventor, Ernst Roethke. However, the arrangement shown in that German Published Patent is designed for a radically different spindle type, and is not suitable for a winding machine for threads such as synthetic filament and glass fiber.

SUMMARY OF THE INVENTION

Therefore, with the foregoing in mind, it is a primary object of the present invention to provide a new and improved construction of a thread-catching device for a winding machine which is not afflicted with the drawbacks and limitations of the prior art constructions.

Still a further significant object of the present invention is directed to the provision of a new and improved construction of a thread-catching device for a chuck or chuck structure o a winding machine for threads or the like, such as synthetic plastics filament, glass fiber strands and so forth, wherein the chuck or chuck structure is adapted to be cantilever-mounted for rotation about a longitudinal axis thereof, and the thread-catching device is capable of reliably catching the thread or the like for ultimate transfer to and winding upon an associated bobbin tube.

Another important object of the present invention is directed to the provision of a new and improved construction of a thread-catching device for a chuck of a winding machine for threads or filamentary materials, wherein the thread-catching device is of relatively simple construction and design, extremely reliable in operation, not readily subject to breakdown or malfunction, and requires a minimum of maintenance and serving.

Now in order to implement these and still further objects of the invention, which will become more readily apparent as the description proceeds, the thread-catching device of the present invention is manifested by the features that it comprises an element movable radially between retracted and extended positions under the action of centrifugal force when the chuck is rotated about its longitudinal axis at or above a predetermined operating speed in use. The element has a head portion which in use projects radially outwardly from the bobbin tube receiving surface of the chuck when the element is in its extended position, and is located inwardly of this bobbin tube receiving surface when the element is in its retracted position. The head portion may include or be adapted to provide part of a thread catching means or device adapted to receive and catch a thread e.g. as the thread is being moved axially of the chuck. Such thread catching means or device may be of a currently conventional type. The head portion may also include thread severing means and/or thread guiding means for guiding axial movement of the thread into the thread catching means or device.

The chuck or chuck structure may include guide means for guiding the radial movement of the element between its retracted and extended positions. Biasing means may also be provided tending to return the element towards its retracted position.

Means may also be provided to exert a force on the element urging the head portion, when in its extended position, into contact with an axial end face on an adjacent bobbin tube. The last-mentioned means may be adapted to define a pivoting system for the element, such that when the element is in its extended position, the centrifugal force acting thereon is converted by the pivoting system into a turning moment urging the head portion of the element into contact with the bobbin tube. The pivoting system may include abutment or contacting surfaces, spaced from a pivot point on the chuck and on the element, adapted to engage when the element is in its extended position. The pivoting system may further include a suitable connection means between the element and a biasing means tending to return the element to its retracted position.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 2 shows a partial cross section through one embodiment of a chuck for use in a winding machine as shown in FIG. 1;

FIG. 3 shows a sectioned side elevation of a detail taken from FIG. 2;

FIG. 12 is a side elevation similar to FIG. 3, but showing an alternative embodiment of the thread-catching element in a retracted condition;

FIG. 13 is a view similar to FIG. 12 but showing the thread-catching element in an extended condition;

DETAILED DESCRIPTION OF THE PREFERRED EMBODIMENTS

Describing now the drawings, it is to be understood that to simplify the showing thereof only enough of the structure of the winding machine and its related chuck or chuck structure and its thread-catching device has been illustrated therein as is needed to enable one skilled in the art to readily understand the underlying principles and concepts of the present invention.

General Remarks

Figure 1:
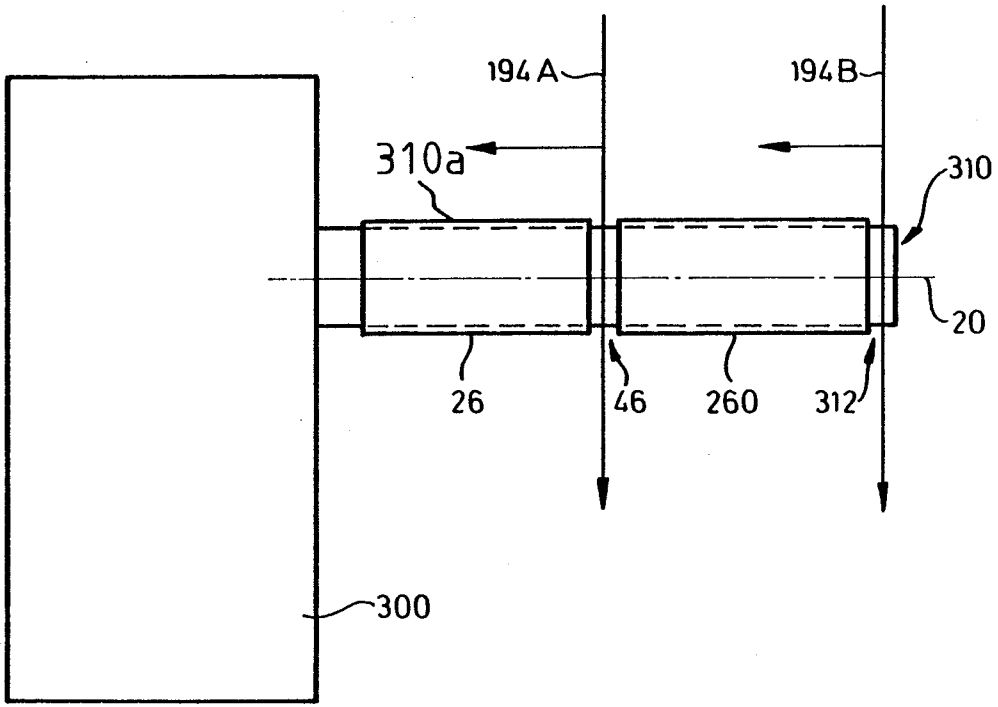
FIG. 1 shows a highly simplified side elevation of a winding machine including a chuck in accordance with the invention.

FIG. 1 shows a winding machine comprising a headstock 300 and a chuck or chuck structure 310 cantilever-mounted at one end (not shown) in the headstock 300. The headstock 300 contains conventional drive systems so that the chuck or chuck structure 310 containing a chuck member 310*a* can be rotated in use about its longitudinal axis 20, at which time the chuck 310 carries an inboard bobbin tube 26 and an outboard bobbin tube 260 upon which respective thread packages are to be formed. A gap 46 is arranged by any suitable and therefore not particularly shown means between the adjacent axial ends of bobbin tubes 26 and 260 and a thread guide portion 312 is left free at the outer end of the chuck 310. Before starting package winding, a thread 194A is laid in the gap 46 and a second thread 194B is laid on the guide surface 312. The threads 194A and 194B are being delivered in a direction assumed to be from top to bottom of FIG. 1 at a predetermined linear speed.

The threads 194A and 194B are now moved axially towards the inboard end of the chuck or chuck structure 310, so that the thread 194B moves onto bobbin tube 260 and the thread 194A moves onto bobbin tube 26. Before reaching their respective bobbin tubes 26 and 260, however, the threads 194A and 194B, respectively are received and caught by respective thread-catching devices or thread-catching and severing devices. Such devices have not been shown in FIG. 1 but embodiments will be described with reference to the other figures. The downstream portions of the threads 194A and 194B, considered with reference to the delivery direction thereof, are appropriately severed from the remainder, and the upstream portions move onto the respective bobbin tube 26 and 260 for winding of thread packages thereon.

Winding machines of the type generally shown in FIG. 1 can be seen from U.S. Pat. No. 4,497,450, granted Feb. 5, 1985, and listing as the inventors, Kurt Schefer et al, entitled: "FILAMENT WINDING MACHINE". In this context, the question of whether the winding machine or winder has two chucks or chuck structures as shown in the aforementioned U.S. Pat. No. 4,497,450, or one chuck or chuck structure as shown for instance in FIG. 1, is irrelevant. Arrangements for causing the required movements of the threads relative to the chuck or chuck structure can be seen from U.S. Pat. No. 3,920,193, granted Nov. 18, 1975, and listing as the inventors, Peter Gujer et al, entitled: "WINDING APPARATUS WITH AUTOMATIC CHANGING OF TUBES OR THE LIKE" and from pending European Patent Application No. 86,104,646.4, filed on Apr. 4, 1985 in the names of Adolf Flüeli, Heinz Oswald, and Kurt Schefer, now European Published Patent Application No. 0198365, published Oct. 22, 1986.

The full disclosure of the aforementioned U.S. Pat. Nos. 4,497,450 and 3,920,193 and of European Published Patent Application No. 0198365 are hereby incorporated into the present specification by reference.

First Embodiment-Co-Pending United States application Ser. No. 723,981, now U.S. Pat. No. 4,641,793, granted Feb. 10, 1987.

The thread-catching devices to be described with reference to FIGS. 2 through 11 are particularly, but not exclusively, designed for use in a chuck or chuck structure in accordance with the commonly assigned co-pending U.S. patent application Ser. No. 723,981 (hereinafter the "aforementioned co-pending United States patent application Ser. No. 723,981"), filed Apr. 16, 1985, and entitled "THREAD WINDING MACHINE AND METHOD OF PERFORMING AUTOMATIC CHANGEOVER OF A WINDING OF A THREAD". The full disclosure of that aforementioned co-pending U.S. patent application Ser. No. 723,981 is incorporated into the present specification by reference. In order to facilitate coordination of the descriptions in the two applications, the reference numerals used in FIGS. 2 through 11 of this application generally correspond as far as possible with numerals used for similar parts in the aforementioned co-pending U.S. patent application Ser. No. 723,981.

FIG. 2 shows a section through part of the chuck or chuck structure 310 in the region of the gap 46 or of the guide surface 312; in all respects relevant to the present invention, the arrangements at gap 46 and guide surface 312 are identical, and no distinction will be made between them. The chuck structure or chuck 310 comprises a chuck member 310*a* which includes an outer tubular portion 22 providing simultaneously the main load-bearing element of the cantilevered portion of the chuck 310 and a casing for the other elements thereof. Bobbin tubes 26 and 260 are received on the cylindrical, outer bobbin tube receiving surface 22' of the outer tubular portion 22 and are located and secured relative thereto by bobbin tube positioning and gripping systems described in detail in the aforementioned co-pending U.S. patent application Ser. No. 723,981.

One of the internal components of the chuck or chuck structure 310 is a support element 150 which is disposed in a smooth sliding fit on the internal, cylindrical surface of the outer tubular portion 22. For reasons not related to the present invention, support element 150 may be formed as a ring in the region of the gap 46 and as a disc in the region of the guide surface 312. However, only the circumferential portion of element 150 is of particular interest in the present context, and that circumferential portion is provided with four slots, one of which is indicated at 155 in FIG. 2. The four slots 155 are equiangularly disposed around the longitudinal axis 20. Tubular portion 22 has four bores or openings 176 extending radially from its outer or bobbin tube receiving surface 22' to open onto respective ones of the slots 155. Each bore 176 and slot 155 combination acts as a guidance and locating means for a respective thread-catching and severing device 178. Since the operation of each such thread-catching and severing device 178 is essentially the same, only one will be referred to in the subsequent description.

Generally, as indicated in FIG. 3, the thread-catching and severing device 178 comprises a radially outward head portion 180, an intermediate body portion 182 and a radially inward foot portion 184. Further details of the structure can be seen from FIGS. 4 to 6.

Foot portion 184 has a pair of oppositely facing, flat side guide faces or surfaces 318 (FIGS. 5 and 6), which engage the oppositely facing side walls 155' of slot 155 (FIG. 2) and locate thread-catching and severing device 178 circumferentially of the chuck 310. The spacing of the flat side faces or surfaces 318 of the foot portion 184 is such that this foot portion 184 possesses a smooth, sliding fit in its associated slot 155 between a radially inward position (not shown in FIGS. 2 and 3) in which the foot portion 184 engages base surface 157 at the base of the slot 155, and a radially outward position which will be further described below. The axial length of foot portion 184 (from right to left as viewed in FIG. 3) is greater than the spacing of the oppositely facing flat side guide faces or surfaces 318.

Figure 4:
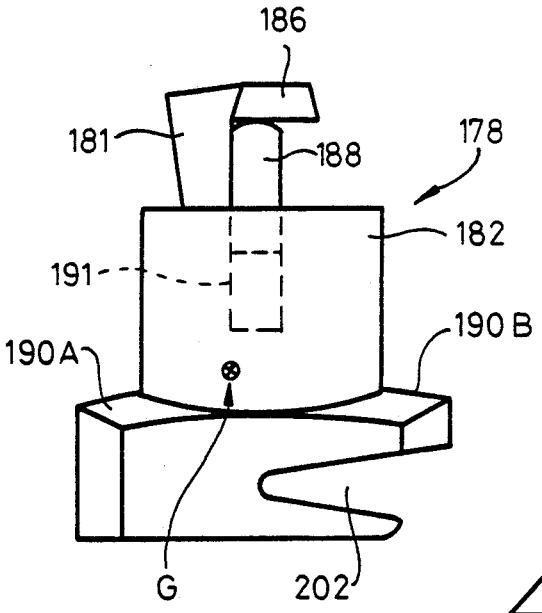
FIG. 4 shows a detailed side elevation of one embodiment of a thread-catching element in accordance with the invention.
Figure 5:
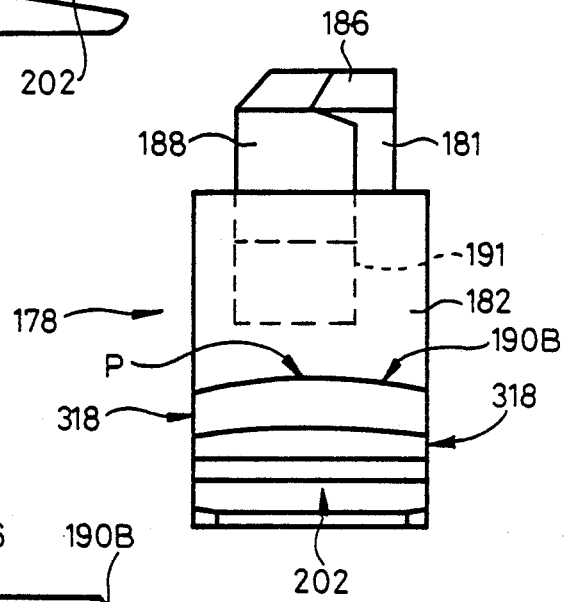
FIG. 5 shows an end elevation of the thread-catching element shown in FIG. 4.

Intermediate body portion 182 is substantially cylindrical with a diameter approximately equal to the spacing of the flat side faces or surfaces 318. Accordingly, the foot portion 184 presents radially-outwardly facing surfaces 190A and 190B on opposite sides of the intermediate body portion 182 as viewed in FIGS. 4 and 6. As seen in FIG. 5, at least surface 190A has a rounded apex forming a blunt "edge" extending axially, attention being directed to reference character P in FIG. 5.

Figure 6:
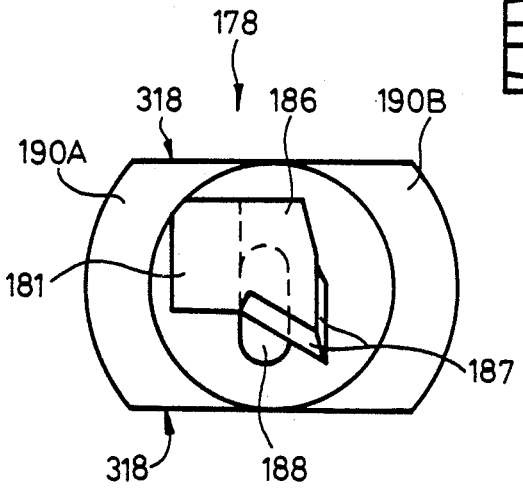
FIG. 6 shows a plan view of the thread-catching element shown in FIGS. 4 and 5.

Head portion 180 comprises a support pillar or pillar member 181 integral with the intermediate body portion 182 and projecting radially from the outer end thereof in relation to the chuck structure 310. At its own outer end, this pillar 181 carries an axially projecting tooth 186 formed with a thread guiding edge 187 (FIG. 6). The form and function of this tooth 186 can be seen from the aforementioned U.S. Pat. No. 4,106,711, the disclosure of which is hereby incorporated in the present specification by reference. It is here, however, briefly remarked that, as explained in the just mentioned U.S. Pat. No. 4,106,711, a tooth, like the tooth 186 coacts with a clamping element like clamping element 188 to be described immediately below for tensioned clamping of the thread at the clamping position defined between the tooth 186 and the clamping element 188. As a result, the tensioned thread can be appropriately severed or broken downstream of this clamping position. Where, as here, and as evident from FIGS. 4 and 6, the thread guiding edge 187 has, for instance, a sharp or tapered configuration, then this thred guiding edge 187 provides a defined thread severing or breaking location downstream of the clamping position where the tensioned thread is then positively severed or broken. The intermediate body portion 182 has a radial bore 191 (FIGS. 4 and 5) which is elongated in the transverse direction between the guide faces or surfaces 318. Bore 191 contains the clamping element 188 slidable radially in the bore 191. When the chuck or chuck structure 310 together with its chuck member 310*a* is rotating in use, the clamping element 188 slides radially outwardly in its bore 191 to engage the underside or radially inwardly facing surface on tooth 186, as shown in FIGS. 4 and 5. The zone of engagement between the clamping element 188 and the tooth 186 forms the previously noted thread clamping position. When the chuck 310 is at a standstill, the clamping element 188 is no longer firmly pressed against tooth 186, and a thread previously clamped at the clamping position is either automatically released or can be easily withdrawn. Apart from the form of the clamping element 188, the principle of this operation can be seen from U.S. Pat. No. 4,106,711 referred to above, and will not be further described in this specification.

As indicated in FIG. 4, the foot portion 184 has a substantially V-shaped recess 202. The large end of the V opens onto one axial surface of the foot portion 184, the adjacent surface 190B and the V-shaped recess 202 extend from that axial surface in a direction opposite to the projection of the tooth 186 from its support pillar 181. The V-shaped recess 202 enables cooperation of the thread-catching and severing device 178 with a biasing means tending to urge the thread-catching and servering device 178 into a retracted or radially inward position relative to the chuck 310 as will now be described with reference to FIG. 3.

Provided within the outer tubular portion 22 adjacent support element 150 is a second support element 159. A disc or ring or carrier 198 of mounting means 198,200 is located in engagement with the second support element 159 and carries biasing means of the mounting means 198,200 comprising four spring arms 200 projecting axially therefrom into respective slots 155. Each spring arm 200 has a free end **200*a* remote from the carrier 198, and this free end 200*a* can seat against the rounded apex 202*a* of recess 202. The spring arm 200 exerts a bias force on the associated foot portion 184 in a radially inward direction (downwards considered with reference to FIG. 3) tending to urge this foot portion 184 into engagement with the base surface 157 in slot 155. The spring arm 200 can, however, flex to permit the thread-catching and severing device 178 to move to its extended or operative position (FIG. 3) as will now be described with reference to the series of diagrams in FIGS. 7 to 12**.

Operation

Figure 7:
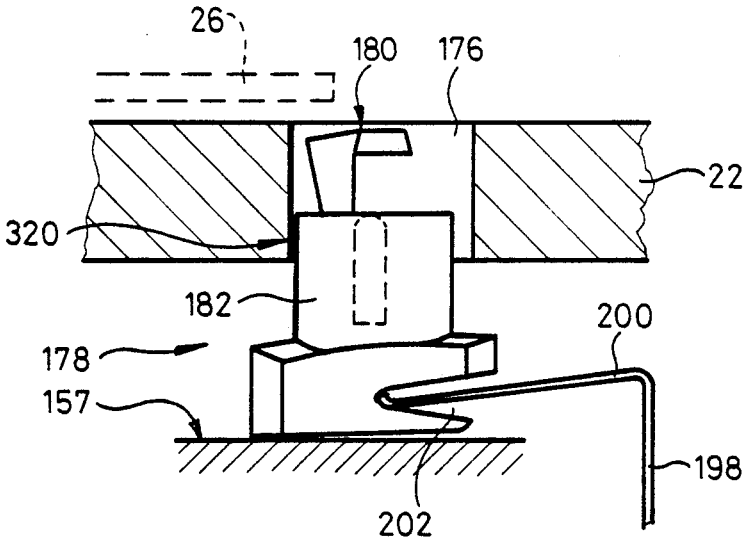
FIGS. 7 to 11 are diagrams representing movement of the thread-catching element shown in FIGS. 4 through 6 from its retracted position to its extended position in use.

FIG. 7 shows the thread-catching and severing device 178 in its retracted position with the foot portion 184 in engagement with the base surface or surface 157. Head portion 180 and a radially outer part of body portion 182 lie within the radial depth of the associated bore 176. The thread-catching and severing device 178 is located axially relative to the chuck or chuck structure 310 by engagement of the intermediate body portion 182 with the inboard side of bore 176, as at 320 in FIG. 7, and by the engagement of the free end **200*a* of the spring arm 200 with the apex 202*a* of recess 202. An inboard bobbin tube, indicated in dotted lines at 26 in FIG. 7, can be moved axially over the bore 176 without interference from the thread-catching and severing device 178. The clamping element 188 (FIG. 4) is assumed to be withdrawn into its bore 191 in the diagram of FIG. 7; this assumes the "upright" disposition of the thread-catching and severing device 178 as illustrated in the Figure—if the device happened to be disposed "head down", depending upon the rotational disposition of the chuck 310 a standstill, the clamping element 188 might be engaging tooth 186** under its own weight, but without any significant thread clamping pressure.

When bobbin tube 26 has been secured relative to the chuck 310, and the latter has been set in rotation for acceleration towards its operation speed, centrifugal force begins to act upon the thread-catching and severing device 178. When this force is sufficient to overcome the bias provided by spring arm 200, the associated thread-catching and severing device 178 will begin to move away from face to face engagement with the base surface 157. At the operating speed of the chuck 310, the thread-catching and severing device 178 will have reached an operating position illustrated in FIG. 11 and also FIG. 3. An imaginary sequence of movements of the thread-catching and severing device 178 from the retracted to the operating position will be described with reference to FIGS. 8 to 11. It is not intended to indicate that each thread-catching and severing device 178 will on all occasions perform such a sequence of movements. The described sequence does, however, indicate the points at which the thread-catching and severing device 178 must have freedom to move and to adapt relative to its guiding and locating systems, and where those systems can be arranged to direct the thread-catching and severing device 178 into the required final operating position.

The location of the center of gravity G of the thread-catching and severing device 178 as viewed in the side elevation of FIG. 4 is of special significance in relation to the movement to be described. Center of gravity G is located within the intermediate body portion 182, between the apex **202*a* of recess 202 and the surface 190A. The center of gravity G has not been marked on FIGS. 5 and 6 because for purposes of the present description its location relative to those figures is not significant. It will lie in or very close to an axial mid-plane through the foot portion 184 and intermediate body portion 182. In the following description, the total centrifugal force acting on the thread-catching and severing device 178** will be assumed to be localized and acting radially through the center of gravity G.

Figure 8:
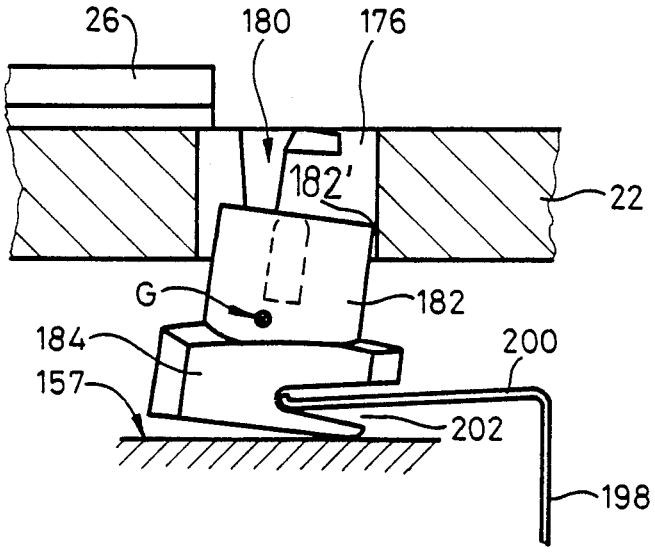

Turning now to FIG. 8, it is noted firstly that the bore 176 is dimensioned to provide a clearance relative to the intermediate body portion 182. Thus, when the centrifugal force first becomes effective to move the thread-catching and severing device 178, it may tend to tilt the thread-catching and severing device 178 in a clockwise direction as viewed in FIG. 8 about the zone of contact of spring arm 200 with the apex region or apex **202*a* of recess 202. Such tilting is, however, limited by engagement of the free edge 182' of the intermediate body portion 182 with the outboard side of the bore 176, as shown in FIG. 8**.

Figure 9:
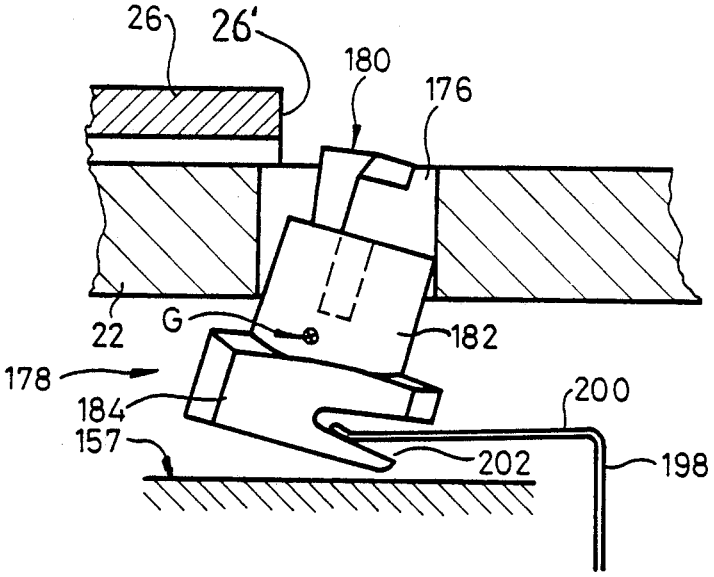

Due to the clearance between the intermediate body portion 182 and the bore 176, tilting of the thread-catching and severing device 178 in a clockwise direction relative to the pertinent Figures under discussion will occur at the latest after the centrifugal force has overcome the bias of the spring arm 200 sufficiently to lift the foot portion 184 clear of the base surface or surface 157. This condition is illustrated in FIG. 9. The effect of this tilting movement is to move the head portion 180 in the outboard direction clear of the end surface or end face 26' of the adjacent bobbin tube 26, which cannot therefore interfere with movement of the thread-catching and severing device 178 to its operating position. This tilting movement is limited, if necessary, by engagement of the intermediate body portion 182 with the radially inner, inboard edge of the bore 176, as also illustrated in FIG. 9. As soon as this latter engagement of the intermediate body portion 182 with the outer tubular portion 22 of the chuck member **310*a* occurs, further radially outward movement of the thread-catching and severing device 178 will be asccompanied by "straightening up" of the intermediate body portion 182 in the related bore 176**, so that the thread-catching and severing

Figure 10:
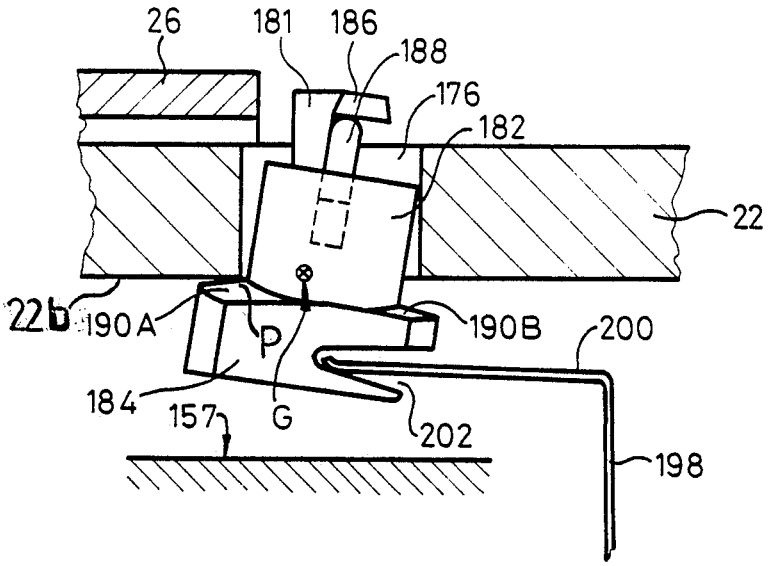

178 moves towards the condition illustrated in FIG. 10 through increased flexing of the spring arm 200.

In FIG. 10, apex P on surface 190A, is assumed to have come into engagement with the internal surface 22*b* of the outer tubular portion 22 adjacent the bore 176. The zone of engagement on this apex P provides a new pivot point about which the thread-catching and severing device 178 will now tend to tilt in the anti-clockwise direction relative to the Figures. This new tilting movement must, however, be accompanied by at least slightly increased flexing of the spring arm 200, whereas the previous tilting movement was permitted by the play between the spring arm 200 and its contact surfaces in the recess 202. By this stage, the centrifugal force acting on the clamping element 188 has increased to a point at which the clamping element 188 is urged outwardly against the underside of the tooth 186. Apex P ensures sufficiently accurate definition of the new pivot point.

Tilting of the thread-catching and severing device 178 about its zone of contact on surface 190A will continue until one of two things has happened;

(a) in the absence of a bobbin tube 26 (condition not illustrated), the surface 190B comes into contact with the internal surface 22*b* of the outer tubular portion 22 on the opposite side of the bore 176 from the surface 190A, or (b) the radially outer end of the pillar 181 engages the axial end surface or end face 26′ on the bobbin tube 26 (FIG. 11), which has been correctly located relative to the bore 176, e.g. by the bobbin tube positioning systems described in the aforementioned co-pending U.S. patent application Ser. No. 723,981. This condition will be reached at or before the predeterminate operating speed of the chuck or chuck structure 310.

Figure 11:
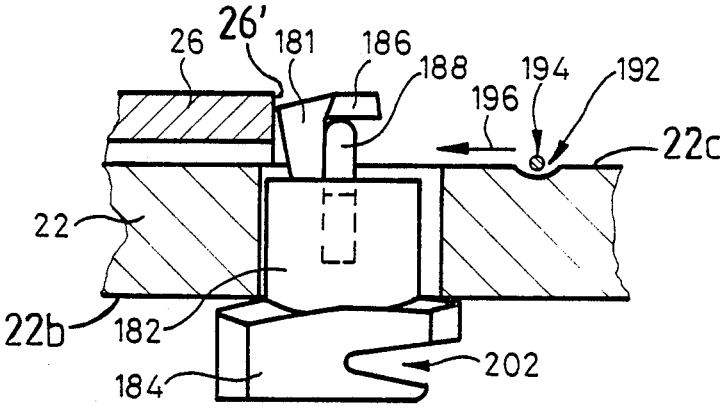

As indicated in FIGS. 2 and 11, a circumferential groove 192 is provided in the external surface 22*c* of the outer tubular portion 22 adjacent but on the outboard side of the bores 176. The thread, here indicated by reference numeral 194, can now be laid in this circumferential groove 192 and then moved axially in the direction of the arrow 196 in FIG. 11 underneath i.e., radially inwardly from tooth 186. The tooth 186 then guides the thread 194 into the clamping position in a manner described in the aforementioned U.S. Pat. No. 4,106,711, the thread 194 is severed downstream from the clamping position (as described with reference to FIG. 1) and the upstream portion of the thread 194 is transferred over the tooth 186 and the adjoining portion of the support pillar or pillar member 181 onto the bobbin tube 26. The firm contact between the support pillar 181 and the axial end surface or end face 26′ of the bobbin tube 26 ensures that the thread 194 cannot be caught between these parts during transfer from the thread-catching and severing device 178 onto the bobbin tube 26. Package winding can now begin, but since this operation is not a subject of the present invention, it will not be described herein.

When package winding is complete, rotation of the chuck or chuck structure 310 is decelerated. As the effect of the centrifugal force is reduced, the bias force applied by the spring arm 200 becomes effective to tilt the thread-catching and severing device 178 away from the bobbin tube 26, and then to return it to the retracted position illustrated in FIG. 7. This sequence of events is substantially the reverse of those described with reference to FIGS. 8 through 10, and will not be dealt with in detail. As may be seen in FIG. 3, when the thread-catching and severing device 178 is in its operative position, the spring arm 200 can be supported against a convex surface 201 on an axial projection provided on the support element 159. If necessary, the support element 159 can be axially movable after return of the thread-catching and severing device 178 to ensure that the thread-catching and severing device 178 is brought back to the "upright" position illustrated in FIG. 7.

Second Embodiment

A second embodiment of the invention is illustrated in FIGS. 12 and 13. As far as possible, similar reference numerals are generally conveniently used to indicated similar parts. Thus, each of FIGS. 12 and 13 shows an outer tubular portion or chuck portion 22A similar to the outer tubular portion or chuck portion 22 illustrated in FIGS. 2 to 11. FIG. 13 shows an inboard bobbin tube 26 and an outboard bobbin tube 260 as also shown in FIG. 1.

Within the outer tubular portion 22A, there is a support element 150A similar to the support element 150 in FIG. 2, and provided with four similar slots 155A (only one of which can be seen in FIGS. 12 and 13). For each slot 155A, the outer tubular portion 22A has a corresponding radial bore 176A.

The thread-catching device now to be described in FIGS. 12 and 13 differs radically from that shown in FIGS. 2 to 11. The thread-catching device essentially comprises two elements, namely an element 210 which is substantially L-shaped as viewed in side elevation, and a retaining element 212 in the form of an elongated lever 212′. In order to enable illustration of various positions for the L-shaped element 210, the full illustration of the retaining element 212 has been omitted from FIG. 13. However, the retaining element 212 is represented in the latter Figure by a dotted line 212A representing the longitudinal axis of the retaining element 212 itself.

As illustrated in the sectioned view of FIG. 13, the L-shaped element 210 has an opening 214 in the region at which the two arms 210′ and 210″ of the L join together. This opening 214 is large enough to receive one end 212″ of the retaining element 212, as indicated by the dotted line illustration in FIG. 12. Elements 210 and 212 have aligned, not particularly referenced, bores receiving a pivot pin 216. The bores and the pivot pin 216 together form a pivot joint which connects elements 210 and 212 together while leaving the substantially L-shaped element 210 free to pivot relative to the retaining element 212 about the longitudinal axis of the pivot pin 216 which extends at right angles to the plane of the drawing of FIG. 13 and to the longitudinal axis 212A of the retaining element 212.

At its other end 212‴, the retaining element 212 is secured by a second pivot pin 218 to the support member 150A. For this purpose, the pivot pin 218 extends across the slot 155A between the sidewalls thereof and forms a second pivot joint securing the retaining element 212 within the slot 155A while leaving the retaining element 212 free to pivot about the longitudinal axis of pivot pin 218 which is essentially parallel to the longitudinal axis of the pivot pin 216. Retaining element 212 extends away from the pivot pin 218 in a direction generally longitudinally of the chuck or chuck structure 310.

A bridging or bridge member 220 extends across slot 155A at the outer circumference of the support member 150A. A suitable compression spring (not shown) extends between bridge member 220 and a recess 222 (shown only in FIG. 12) in the radially-outwardly facing surface of the retaining element 212. The compression spring tends to urge the retaining element 212 into a retracted or radially-inner position which is illustrated in FIG. 12. In this position, which is adopted by the retaining element 212 when the chuck 310 along with its chuck member 310*a* is not rotating, the substantially L-shaped element 210 is wholly withdrawn within the radially outer cylindrical or bobbin tube receiving surface of the outer tubular portion or chuck portion 22A, and such radially outer cylindrical surface is free to receive the bobbin tubes 26 and 260 (FIG. 13) without interference with the movement of the bobbin tubes 26 and 260 axially along the chuck or chuck structure 310.

From the previous description, it will be apparent that the one arm 210' of the L-shaped element 210 extends generally radially of the chuck 310 away from the pivot pin 216; at its radially outer or free end, this arm 210' is formed with a bulbous head or head portion 224. The other arm 210" of the L-shaped element 210 extends generally axially of the chuck 310 away from the pivot pin 216 and the free end of the axial arm 210" is formed with an enlargement which has a radially outwardly facing surface 226 for a purpose to be described further below.

In the withdrawn or retracted condition, as illustrated in FIG. 12, the head or head portion 224 on the radially-outwardly extending arm of the retaining element 210 extends into, but not through, the bore 176A. In this condition, which is adopted when the chuck 310 is not rotating, the axially-extending arm 210" of the retaining element 210 is seated on the base or base surface 157A of the slot 155A. In this condition, bobbin tubes 26 and 260 (FIG. 13) can be freely moved onto and off the chuck 310, and when correctly located relative to the chuck 310 and its chuck member 310*a*, they leave a gap 46 in communication with the set of openings 176A.

When the chuck 310 starts to rotate about its longitudinal axis 20 (FIG. 1), each pair of elements 210 and 212 is subjected to centrifugal force tending to pivot the pair of elements 210 and 212 about the axis of its respective pivot pin 218 against the biasing force of the compression spring engaging bridge member or portion 220. The mass of the element 210 is so distributed that the center of gravity G of this element 210 is located within the axially extending arm 210" between the pivot pin 216 and the enlargement having the radially outwardly facing surface 226. The centrifugal force acting on the element 210 can again be assumed to act locally at the center of gravity G. Accordingly, as the element 210 moves away from the base surface 157A, it tends to rotate in a clockwise direction (as viewed in FIGS. 12 and 13) about the axis of the pivot pin 216 due to the moment created by the centrifugal force at G. In the initial phases of outward movement, therefore, centrifugal force tends to tilt the head portion 224 away from the bobbin tube 26, so that the radially extending arm 210' can pass freely into the gap 46 between the bobbin tubes 26 and 260.

However, the axially extending arm 210" of the element 210 extends beyond bore 176A so that the radially outwardly facing surface 226 eventually comes into contact with the internal surface 22*b* of the outer tubular portion or chuck portion 22A, as illustrated in FIG. 13. Centrifugal force acting on both elements 210 and 212 is still tending to urge these elements 210 and 212 radially outwardly, so that the pivot pin 216 tends to continue its radially outward movement Since the axially extending arm 210" is retained by its contact with the outer tubular portion or chuck portion 22A, the substantially L-shaped element 210 now pivots in an anti-clockwise direction considered with reference to FIG. 13 about the axis of the pivot pin 216. The head or head portion 224 is therefore pivoted into engagement with the adjacent end surface or end face 26' of the bobbin tube 26. As indicated by the full-line and dotted-line illustrations, the degree of anti-clockwise pivoting of the substantially L-shaped element 210 will depend upon the length of the bobbin tube 26, which is subject to a degree of variation within specified tolerances which can be allowed for in the design.

As may be seen in FIG. 12, the bulbous head or head portion 224 forms a rounded bulge to engage the axially-facing end surface or end face 26' on the bobbin tube 26. This bulge tends to penetrate into the material of the bobbin tube 26 to at least a limited degree, but nevertheless a wedge-shaped gap 228 (FIG. 13) will be left even after maximum penetration. If, now, a thread (not shown) is laid in this wedge-shaped gap 228, it will tend to pass into the narrowest portion of the wedge-shaped gap 228 and thereby to be clamped between the bulbous or head portion head 224 and the bobbin tube 26. The bulbous head or head portion 224 is not formed with a specific thread severing means; accordingly, severing of the thread must be effected by tearing induced by high tension between the clamping position at the bulbous head or head portion 224 and a package which is to be removed from the winding machine. This arrangement is therefore primarily suitable for finer, weaker threads.

At the completion of the winding operation, reduction of the centrifugal force will permit the compression spring engaging bridge portion 220 to return the lever or arm 212' of the retaining element 212 towards the withdrawn position. Radially inward movement of the pivot pin 216 will permit the bulbous head or head portion 224 to pivot away from the bobbin tube 26, and thus release the previously clamped thread. When the chuck or chuck structure 310 is stationary, elements 210 and 212 have been returned to the retracted position (FIG. 12) so that the bobbin tubes can be moved over the bores 176A without interference.

The arrangement shown in FIGS. 12 and 13, carries the disadvantage that the thread must be laid accurately in the wedge-shaped gap 228. The bulbous head 224 can be formed with a degree of bulge towards the bobbin tube 26, so as to provide a radially outwardly facing surface on the bulbous head 224 to receive the thread; however, this receiving surface cannot be made very extensive. As an alternative, the thread could be laid first upon the bobbin tube 26, then moved into the wedge-shaped gap 228, and then returned to the bobbin tube 26 for winding of a package thereof. However, such a thread guiding procedure is disadvantageous in that it calls for a reversal in movement of a thread guide. These disadvantages can be avoided by an alternative embodiment constructed in accordance with FIGS. 14 and 15. It must be noted, however, that while the embodiment in accordance with FIGS. 12 and 13 can be used in a chuck structure or chuck in accordance with the aforementioned co-pending U.S. patent application Ser. No. 723,981, an embodiment in accordance with FIG. 15 can be used with such a chuck structure only in limited circumstances, which will be further described below.

Third Embodiment

Figure 14:
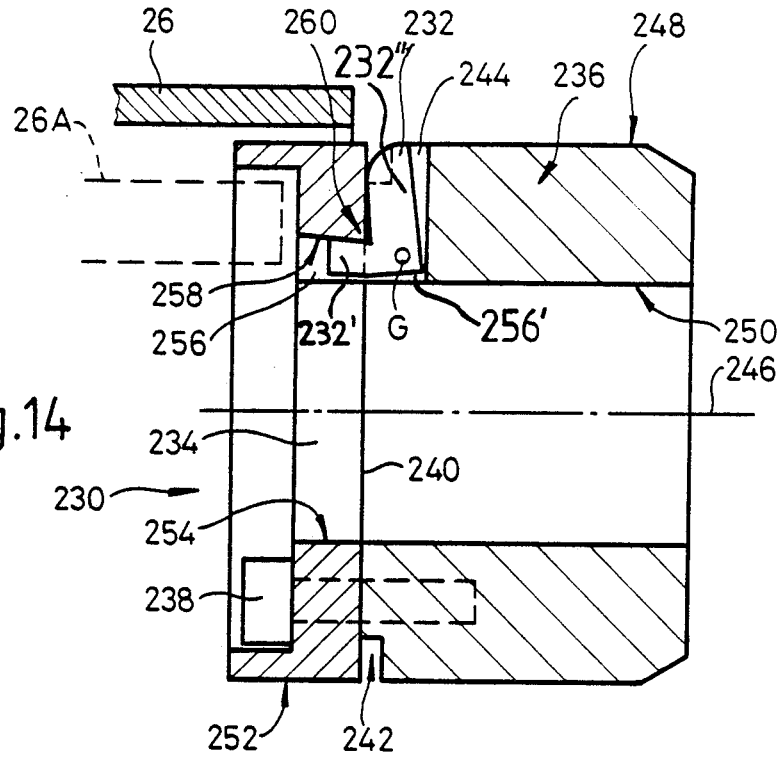
FIG. 14 shows a longitudinal section through a ring structure incorporating another embodiment of thread-catching element according to the invention.

The embodiment illustrated in full lines in FIG. 14 comprises a ring structure, generally indicated at 230, supporting four clamping elements one of which can be seen at 232. The use of a ring structure to support clamping elements is well known in the design of chucks and has been described, for example, in published European Patent Applications Nos. 127,822 and 139,897 and their respective aforementioned cognate U.S. Pat. Nos. 4,482,099 and 4,477,034 to which reference may be readily had. The clamping element, and corresponding features of the ring structure, were, however, different in those prior published applications and cognate patents.

The ring structure 230 shown in FIG. 14 comprises a first ring element 234 and a second ring element 236 joined securing screws or bolts 238 or equivalent structure. The screws 238 draw the ring elements 234 and 236 into firm, mating contact at a joining plane or interface indicated at 240.

Ring element 236 is formed with a peripheral groove 242 adjoining the joining plane or interface 240. The peripheral groove 242 is endless, but is best seen in the lower half of FIG. 14. Furthermore, the ring element 236 has four recesses, one only of which can be seen at 244 in the upper half of FIG. 14. These recesses 244 are formed in the end face of the ring element 236 at the joining plane 240, and they are of limited angular extent and equiangularly disposed about the longitudinal axis 246 of the ring structure 230. Each recess 244 opens onto both an outer cylindrical surface 248 and an inner cylindrical surface 250 of the ring element 236; both of these surfaces 248 and 250 are coaxial with the ring structure 230.

Ring element 234 also has an outer cylindrical surface 252 and an inner cylindrical surface 254 coaxial with the ring structure 230. Four recesses, only one of which can be seen at 256 in the upper half of FIG. 14, are formed in the ring element 234 in alignment with respective recesses 244 in the ring element 236. Each recess 256 opens onto the internal surface 254 of the ring element 234, and also onto the joining plane or interface 240, but extends only part way through the radial thickness of the ring element 234.

Each pair of recesses 244 and 256 forms a substantially L-shaped receiving chamber 256' to receive a respective clamping element 232, which is correspondingly substantially L-shaped as viewed in elevation in FIG. 14. The horizontal bar or arm 232' of the L is located in recess 256 of the chamber 256', and the vertical bar or arm 232" is located in the corresponding recess 244. As clearly seen in FIG. 14, when the horizontal bar or arm 232' of the L engages the radially facing surface 258 within recess 256, the vertical bar or arm 232" of the L is long enough to extend close to, but within, the outer cylindrical surface 248 of the ring element 236. The distribution of mass in each clamping element 232 is such that the center of gravity G of the clamping element 232 is located in the junction region of the two bars or arms 232' and 232" of the clamping element 232 and within the recess 244. The dimensions of the clamping element 232 in relation to its receiving chamber 256' are such that the clamping element 232 has limited freedom of movement in all directions within the receiving chamber 256', but cannot be ejected radially outwardly therefrom. Retention of the clamping element 232 against radially inward movement will be referred to again later in the description.

Ring structure 230 is built into a chuck or chuck structure 310 with the longitudinal axis 246 of the ring structure coaxial with the longitudinal axis 20 (FIG. 1) of the chuck 310. As the chuck 310 together with its chuck member **310*a* is driven into rotation about its longitudinal axis 20, centrifugal force acting on each clamping element 232 immediately drives it radially outwardly into contact with the radially facing surface 258 in the corresponding receiving chamber 256'. Since the center of gravity G lies within the recess 244, however, the clamping element 232 tends to tilt about the zone 260 at the junction of joining plane 240 and radially facing surface 258. In order to ensure that this tilting takes place, the radially facing surface 258 might be given a slight inclination to the longitudinal axis 246 so that the zone 260 is slightly wedge-shaped. Alternatively, or in addition, the corresponding contact surfaces on the clamping element 232 may be shaped to ensure that the desired tilting movement occurs. The result of this tilting movement is indicated in an exaggerated fashion in FIG. 15**.

Figure 15:
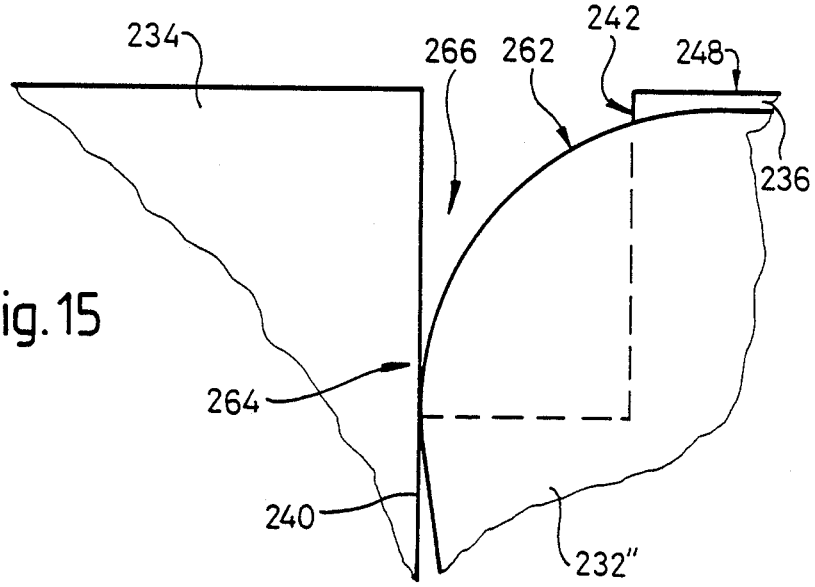
FIG. 15 shows a detail taken from FIG. 14.

As may be seen in FIG. 15, the radially outer end of the vertical bar or arm 232" of the clamping element 232 has a rounded surface 262 facing the ring element 234. When the clamping element 232 is tilted as described above, this rounded surface is driven into contact or abutment with the axially facing or abutment surface of the ring element 234 in the joining plane 240, for example as indicated at 264 in FIG. 15. The zone of contact or abutment may not be exactly at the indicated position 264 because of the freedom of movement of the clamping element 232 within its receiving chamber 256'. However, the rounded surface 262 ensures that for all possible engaging positions of the clamping element 232, a wedge-shaped gap 266 will be formed so as to converge from the outer cylindrical surface 248 (FIG. 14) to the contact zone 264.

Cylindrical surface 248 forms a thread-receiving surface, which may have a thread receiving groove (not shown) similar to the groove 192 in FIG. 11. When the thread is moved axially on surface 248 towards unit or ring element 234, the thread remains on the thread-receiving surface 248 until it reaches the groove 242. As may be seen in FIG. 15, the rounded surface 262 is such that a thread arriving at groove 242, is already aligned with the outermost portion of the rounded surface 262; when the thread falls into the groove 242, it is guided by the surface 262 radially inwardly into the wedge-shaped gap 266 in which it is eventually clamped in a manner similar to the clamping of the thread in the embodiment of FIGS. 12 and 13. It is not essential that the thread immediately passes onto the rounded surface 262 as soon as it falls into the groove 242, but the dimensions of the parts should be such that the thread cannot fall into the recess 244 between the clamping element 232 and the ring element 248.

The ring structure 230 shown in FIG. 14 can be used in two different ways. In the first way, the ring structure 230 is built into the chuck itself. Arrangements for doing this, have not been specifically illustrated in FIG. 14, but they are well-known in the chuck design art; examples of such arrangements are shown in the aforementioned U.S. Pat. No. 4,106,711. In this case, surfaces 252 and 248 will lie in an imaginary cylinder which also contains the outer surface of the chuck casing. In use, a bobbin tube, such as bobbin tube 26 shown in FIG. 14 is passed over the chuck or chuck structure as previously described, and the thread clamping structure presents no interference because all of its elements lie within the outermost cylindrical surface of the chuck casing. Such an arrangement cannot be used in the chuck structure according to the aforementioned co-pending U.S. patent application Ser. No. 723,981. The disadvantage of this arrangement is that the thread clamping positions 264 and 266 (FIG. 15) have a significant spacing radially inwardly from the outer surface of bobbin tube 26. The thread must therefore "climb" from its clamping position onto the bobbin tube surface; this is acceptable in some circumstances, but not in others.

In the latter event, a second mode of use may be adopted in which the ring structure 230 is mounted between adjacent bobbin tubes. This is indicated diagrammatically by the dotted line illustration 26A of a bobbin tube engaging an axial face on the ring element 234; it is emphasized, however, that this illustration is provided only to show the principle involved, since both ring elements 234 and 236 would need modification to enable their use between bobbin tubes. Such modification is also known in the art and is shown, for example, in the aforementioned U.S. Pat. Nos. 4,477,034 and 4,482,099. Such an arrangement could be used with a chuck or chuck structure in accordance with the previously mentioned co-pending U.S. patent application Ser. No. 723,981, since the bobbin tubes and ring structures are moved together onto the outer cylindrical surface of the chuck or chuck structure. In this second mode of use, the thread does not have to climb from the clamping position onto the bobbin tube, but the rings or ring structures have to be removed from the chuck along with the bobbin tubes.

In both modes of use, the thread end should be released by the clamping element 232 when the chuck comes to a standstill. In the absence of centrifugal force, the clamping pressure on the thread end will be so light that it can easily be withdrawn from the clamping position if it has not already been released therefrom. In any event, removal of a package carried by bobbin tube 26 in FIG. 14 by movement of the bobbin tube from left to right as viewed in that figure, will tend to open the clamp on the associated thread end even if there is a tendency for that clamp to "stick" shut.

The arrangement shown in FIG. 14 has the advantage, in relation to the embodiment shown in FIG. 12 and 13, that the clamping element does not tend to dig into the axially facing end of the bobbin tube, and furthermore is not dependent upon an adequate radial thickness of the end face on the bobbin tube. It has the disadvantage that it cannot be used in the preferred chuck structure in accordance with the aforementioned co-pending U.S. patent application Ser. No. 723,981 except in the form of a "push-on" ring. This disadvantage can be avoided by arrangements in accordance with FIGS. 16 through 19.

Fourth and Fifth Embodiments

Figure 16:
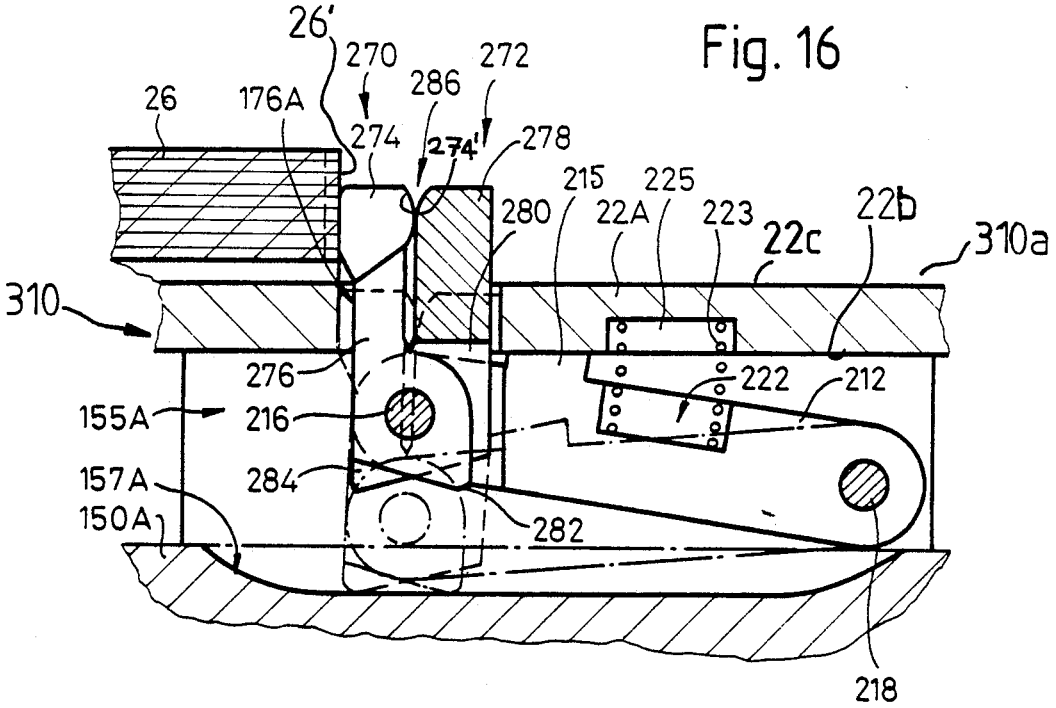
FIG. 16 is a side elevation similar to FIG. 12, but showing still another embodiment of thread-catching element according to the invention.
Figure 17:
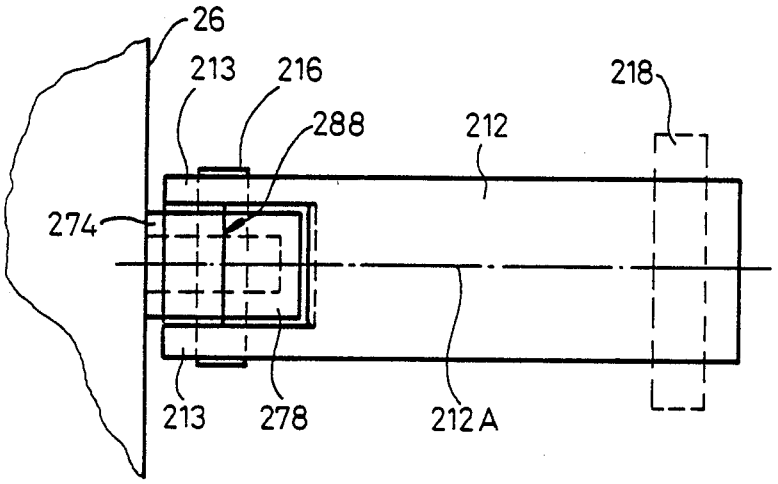
FIG. 17 is a plan view of the arrangement shown in FIG. 16; elevation, respectively, and illustrate yet another embodiment.

A further embodiment is illustrated in FIGS. 16 and 17 and represents a modification of the device shown in FIGS. 12 and 13. As far a possible, the reference numerals used in the description of FIGS. 12 and 13 will be used again to indicate similar parts in the description of FIG. 16 and 17. Accordingly, the tube representing the outer casing or outer tubular portion of the chuck 310 is indicated at 22A, and the inboard bobbin tube is indicated at 26. The support element 150A in FIG. 16 is similar to the corresponding element in FIG. 12, and in particular is provided with slots 155A (only one of which can be seen in FIG. 16) each having a radially facing surface 157A.

In each slot 155A, there is a cross pin or pivot pin 218 supporting a lever or retaining element 212, similar to the correspondingly numbered elements in FIG. 12. A compression spring 223 extends between a recess 222 in lever 212 and a recess 225 in the tube or outer tubular portion 22A of the chuck member **310*a*. At its end remote from the pivot pin 218, the lever 212 has a fork or bifurcated portion provided by extensions 213 (FIG. 17) supporting a cross or pivot pin 216 similar to the correspondingly numbered pivot pin in FIG. 12. However, the elements 270 and 272 supported by the cross or pivot pin 216 in FIG. 16 are radically different from the element 210 illustrated in FIG. 12**.

Element 270 comprises a bulbous head portion 274 at the outer, free end of a single support leg or arm 276. The element 272 also has a head portion or head 278 at the outer, free end of two supporting legs or arms, one of which is indicated at 280. The radially inner end of each support leg 276 and 280 is enlarged and provided with a not particularly referenced through bore to receive the pivot pin 216. Each element 270 and 272 can rotate about the longitudinal axis of the pivot pin 216. The leg 276 fits on to a central portion of the pivot pin 216 (containing the longitudinal axis 212A of lever 212), and the legs 280 of the element 272 are engaged with the pivot pin 216 to either side of the leg 276. For reasons which will be explained later in the description, each extension on each leg 276 and 280 has a projection extending generally radially inwardly, the projection on leg 276 being indicated at 282, and the projection on the illustrated leg 280 being indicated at 284.

Each of these projections 282 and 284 forms a generally rounded apex pointing away from the pivot pin 216. The projection 282 on the leg 276 lies radially inwardly from the element 272, while the projections 284 on the legs 280 lie radially inwardly from the element 270.

The full-line illustration in FIG. 16 represents the device in its extended or operative condition. In this condition, centrifugal force acting on the device has already rotated the lever 212 in a clockwise direction as viewed in the figure against the bias applied by the compression spring 223. This rotation has continued until an abutment 215 on the lever 212 has engaged the internal surface **22*b* of tube or outer tubular portion 22A. Elements 270 and 272, therefore, project radially outwardly from the external or outer surface 22*c* of the tube or outer tubular portion 22A into the gap (not indicated in FIG. 16) between the inboard bobbin tube 26 and an outboard bobbin tube (also not indicated in this Figure, but apparent from FIG. 13**).

Although the center of gravity of element 270 has not been marked on FIG. 16, it is apparent that it will be located to the left of the longitudinal axis of pivot pin 216, as viewed in that Figure. Similarly, the center of gravity of element 272 will be located to the right of the longitudinal axis of the pivot pin 216 as viewed in FIG. 16.

Accordingly, centrifugal force acting on the element 270 will tend to rotate that element 270 in a clockwise direction as viewed in the Figure, while a centrifugal force acting on the element 272 will tend to urge that element 272 in an anticlockwise direction. The mass of element 272 is made greater than that of element 270, so that the pair of elements 270 and 272 tend to rotate in an anti-clockwise direction about the axis of the pivot pin 216. Accordingly, one axially facing surface or abutment surface (to the left as viewed in FIG. 16) on the head portion 274 of the element 270 is forced into contact with the adjacent axially facing end surface or end face 26' on the inboard bobbin tube 26. This tube-engaging face on the head portion 274 is formed as a plane surface which will be referred to further later in this description.

The axially opposite face of the head portion or head 274 has a bulge 274' facing and making firm contact with a rounded surface on the head portion 278 similar to the rounded surface 262 previously described with reference to FIG. 15. Accordingly, a wedge-shaped gap 286 is formed between these two head portions leading into a nip 288 (FIG. 17) where the head portions make contact or abut. This forms a thread clamping position similar to that previously described at 264 in the embodiment of FIG. 15. During deceleration of the chuck or chuck structure 310, as the centrifugal force acting on the thread-catching device is reduced, the compression spring 223 pivots the lever 212 in an anti-clockwise direction around the pivot pin 218. The elements 270 and 272 are therefore drawn radially inwardly of the tube or outer tubular portion 22A through the radial bore 176A similar to that previously described with reference to FIG. 12. When the chuck 310 is rotationally at a standstill, the projections 282 and 284 engage the base or base surface 157A as indicated in during return of the device to its retracted position reduces the clamping effect applied to the thread by nip 288. The thread is therefore free to be drawn out of the nip 288 as the bobbin tube 26, now bearing a wound package, is removed from the chuck 310. In any case, engagement of the projections 282 and 284 with the base surface 157A, applies opposed turning moments to the elements 270 and 272 tending to draw the head portions 274 and 278 apart and positively open the nip 288. This opening effect is limited by engagement of the respective head portions 274 and 278 with the surface defining the bore 176A. As shown by the dash-dotted line illustration, the radially outer ends of the head portions 274 and 278 lie wholly within the bore 176A when in the retracted positions, so that there is no interference with removal of the bobbin tube 26 and a package wound thereon.

As previously mentioned, the bobbin tube engaging surface on the head portion 274, is provided by a plane face, and not by an edge as described for the embodiment illustrated in FIGS. 2 to 6. Accordingly, a wedge-shaped gap of relatively small dimensions compared with gap 286 will be formed at the junction of head or head portion 274 with the bobbin tube 26. Such an arrangement is considered acceptable provided the axial speed of the thread as it moves from the clamping nip 288 onto the bobbin tube 26 is sufficiently high—this corresponds to an adequate angle of inclination of the thread to the chuck axis 20 (or, in FIG. 17, the axis 212A of lever 212) as the thread moves onto the bobbin tube 26. This high axial thread speed (inclination to the chuck axis) can be obtained by an arrangement as disclosed in the aforementioned co-pending U.S. patent application Ser. No. 723,981. The arrangement shown in FIGS. 16 and 17 is therefore particularly designed for use with a thread guiding system as disclosed in the aforementioned co-pending U.S. patent application Ser. No. 723,981. If the axial speed of movement of the thread is relatively low as it passes onto the bobbin tube 26, then the head or head portion 274 can be provided with an edge to avoid formation of a thread-clamping gap at the zone of contact between the head or head portion 274 and the bobbin tube 26.

The bore 176A and the bobbin tube 26, when correctly mounted on the chuck 310, must be so arranged that the bobbin tube 26 will not interfere with the radially outward movement of the elements 270 and 272 as the device shown in FIG. 16 moves to its extended position. The locating means (not illustrated) which locates the bobbin tube 26 relative to the chuck 310, must therefore ensure that the outboard end of the bobbin tube 26 does not project over the inboard edge of the bore 176A. Tolerances in the bobbin tube length will therefore be taken up by additional pivoting of the elements 270 and 272 in an anti-clockwise direction about the pivot pin 216 relative to the position shown in full lines in FIG. 16. However, where a thread moving and guiding system in accordance with the aforementioned co-pending U.S. patent application Ser. No. 723,981 is used, it is preferable to define as closely as possible, the axial location of the point at which the thread is caught. In order to enable this, the axial location of the clamping point must be made independent of the axial end surface or end face 26' of the bobbin tube 26, since variation in the length of bobbin tubes is unavoidable. This implies the possibility of a small gap between the radially outer portion of the thread-catching device and the end surface or end face 26' of the bobbin tube 26. Such a gap is tolerable provided the axial speed of movement of the thread as it moves onto the bobbin tube 26 is high enough. An arrangement which assumes the achievement of this condition is illustrated in FIGS. 18 and 19, and again the same reference numerals have been used to illustrate the same parts. Accordingly, FIGS. 18 and 19 also show an inboard bobbin tube 26, a tube or outer tubular portion 22A forming the chuck casing of the chuck member **310*a*, a bore 176A forming a guide for the thread-catching device which will be described below, a support element 150A within the chuck or chuck structure 310, a slot 155A in the element 150A and a radially facing surface 157A within the slot 155A**.

Figure 18:
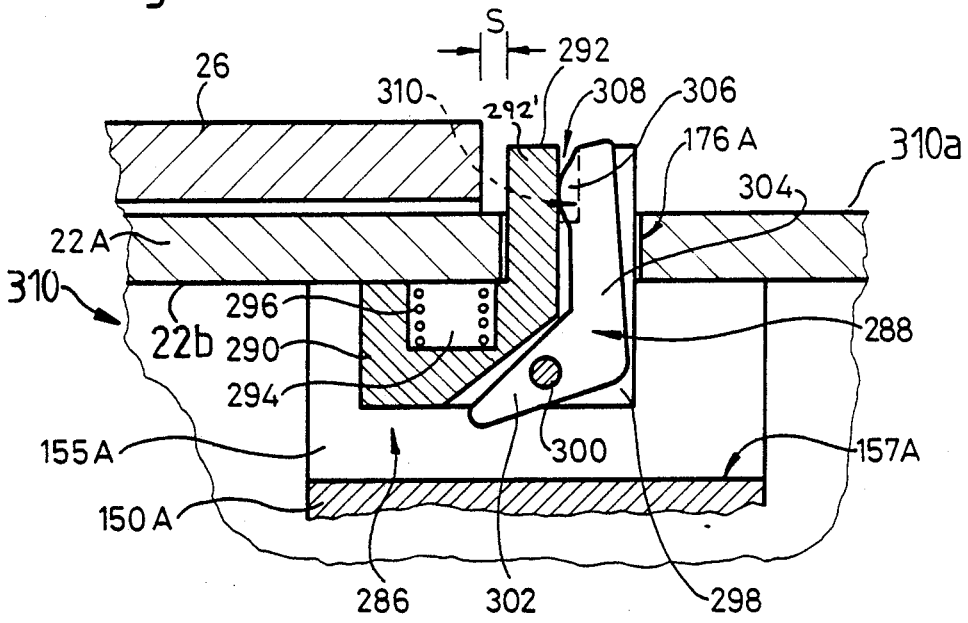
FIGS. 18 and 19 show a side elevation and end thread-catching element according to the invention.
Figure 19:
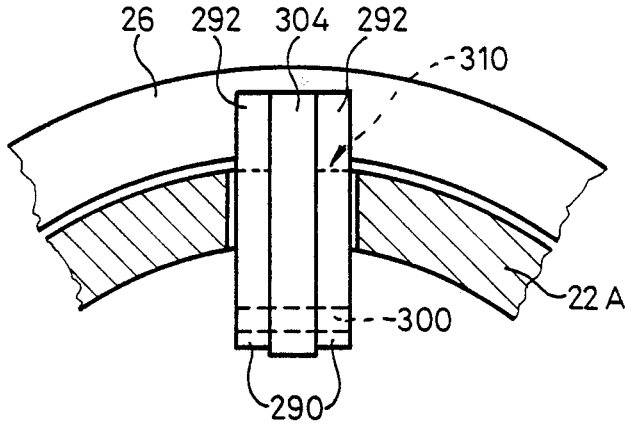

The thread-catching device shown in FIGS. 18 and 19 comprises two generally L-shaped elements 286 and 288, respectively. Element 286 (the "support element") has an axially-extending leg or arm 290 located in the slot 155A, and a radially extending leg or arm 292 which is located in the bore 176A. A recess 294 in the leg or arm 290 receives a compression spring 296 which acts against the radially inner surface of the tube or outer tubular 22A and tends to urge the thread-catching device into the retracted position (not illustrated). In the latter condition, the radially inward facing surface (not specifically indicated) on the leg or arm 290 contacts the base or base surface 157A. In the extended condition of the thread-catching device, as actually illustrated, the radially outwardly facing surface (not specifically indicated) on the leg or arm 290 contacts the internal surface **22*b* of the tube or outer tubular portion 22A** and limits radially outward movement of the thread-catching device under the effects of centrifugal force.

When the thread-catching device is in its retracted condition, the radially outer end 292' of the leg 292 lies wholly within the bore 176A, so that this leg 292 does not interfere with movement of the bobbin tube 26 onto and off the chuck 310. As element 286 is moved radially outwardly under the effect of centrifugal force, the leg 292 runs smoothly in the cylindrical surface defining the bore 176A, and guides movement of the thread-catching device to its fully extended position as illustrated. As in the case of the embodiment described with reference to FIG. 16, the bobbin tube 26, when correctly mounted on the chuck 310, is so located relative to the bore 176A, that it does not interfere with the radially outward movement of the leg 292. In fact, since there is no tilting movement of the leg 292 during this outward movement, a gap S can be created between the bobbin tube 26 and the leg 292; the maximum dimensions of this gap S will be dependent upon the maximum permissible tolerances in the length of the bobbin tube 26.

On its side facing away from the bobbin tube 26, element 286 has a generally L-shaped recess 298 receiving the element 288. A cross or pivot pin 300 extends across this generally L-shaped recess 298 at right angles to the length of the leg 292, and the axial leg 302 of the element 288 is pivotally mounted on the pivot pin 300. The radially extending leg 304 of the element 288 has a bulge 306 at its radially outer end, the bulge projecting towards the bobbin tube 26. Under the effect of centrifugal action, the element 288 tends to rotate in an anticlockwise direction about the pivot pin 300 as viewed in FIG. 18, so that the bulge 306 is urged into engagement or abutment with the adjacent surface on the leg 292. Thus, a wedge-shaped gap 308 and a clamping nip (not specifically illustrated) are created as already described with reference to FIGS. 15, 16 and 17. The leg 292 of the element 286 has a transverse slot 310, similar to the groove 242 shown in FIG. 14, enabling access of the thread to the clamping nip produced between the bulge 306 and the leg 292.

As seen in FIG. 18, the axially extending leg 302 of element 288 may have a free end projecting slightly radially inwardly from the element 286 when the thread-catching device is in its extended position, with the bulge 306 pivoted into clamping contact or abutment with the leg 292. As the thread-catching device is returned to its retracted position, this free end of the leg 302 engages the base surface or surface 157A first, and causes pivoting of element 288 about pivot pin 300 in a clockwise direction as viewed in FIG. 18. This will ensure opening of the clamping nip. However, this special projection of the leg 302 in FIG. 18, and the special projection 282 and 284 described with reference to FIG. 16 are safety measures intended to deal with any tendency for, say, sticky substances to hold the nip closed; in many circumstances, they could be omitted without undesirable effects.

Sixth Embodiment

Figure 20:
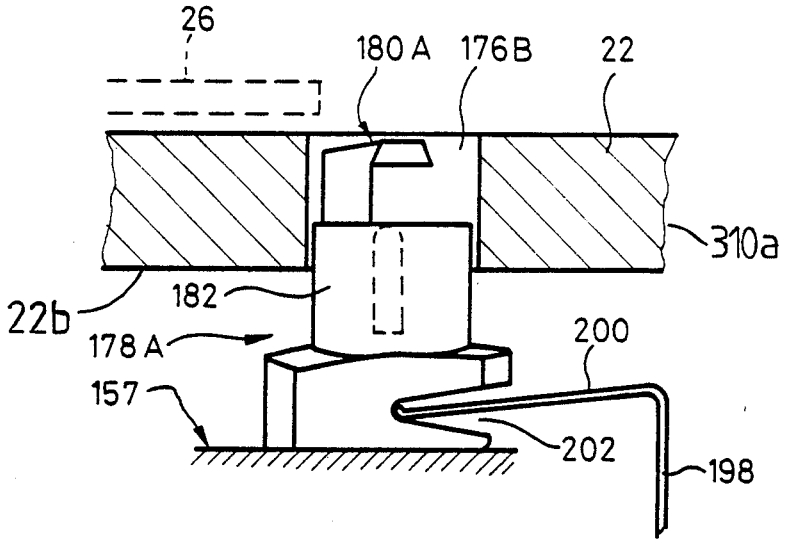
FIGS. 20 and 21 are views corresponding respectively with FIGS. 12 and 13 but showing a thread-catching element in accordance with a modification of the embodiment of FIGS. 2 through 6.
Figure 21:
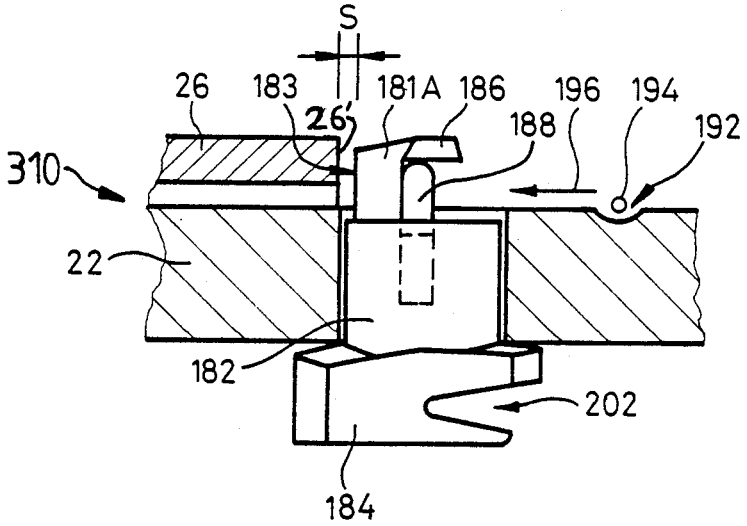

From the description of FIGS. 18 and 19, it will be appreciated that the embodiment of FIGS. 2 through 6 could be modified if the axial speed of movement of the thread onto the bobbin tube 26 can be made sufficiently high. Such an arrangement is shown in FIGS. 20 and 21, which correspond respectively with FIGS. 7 and 11 illustrating the unmodified embodiment. Parts in FIGS. 20 and 21 identical with parts already described with reference to FIGS. 2 to 11 are generally indicated by the same reference numerals, and will not be specifically described again with reference to FIGS. 20 and 21. The modified parts are the head portion or head 180A in FIG. 20, in particular the support pillar or pillar 181A (FIG. 21) and the bore 176B (FIG. 20). Referring first to the latter modification, the dimensions of the bore 176B have been reduced so that this bore 176B is in a closer fit round the intermediate body portion 182 of the thread-catching and severing device or element 178A. The intermediate body portion 182 now has a smooth sliding fit in the bore 176B, so that the thread-catching and severing device or element 178A can move bodily radially between the retracted position (FIG. 20) and the extended position (FIG. 21). The thread-catching and severing device or element 178A is located in the latter position by engagement of the foot portion 184 with the internal surface 22*b* of the tube or outer tubular portion 22 of the chuck or chuck structure 310. As described with reference to the preceding embodiments, the locating means (not shown) for the bobbin tube 26 must maintain the adjacent end surface or end face 26′ of the bobbin tube 26 clear of the bore 176B, so that there is no interference with radial movement of the thread-catching and severing device or element 178A to its extended position. Tilting of the thread-catching and severing device or element 178A during this radial movement is now minimal.

The pillar 181 described with reference to FIG. 4 is modified in that the relatively sharp, bobbin-engaging edge thereon has been eliminated. Pillar 181A (FIG. 21) has a generally plane face 183 directed towards the adjacent axial end surface or end face 26′ of the bobbin tube 26. As in the case of the embodiment of FIG. 18, a small gap S can be created, the maximum dimensions of which are dependent upon the permissible tolerances in the length of the bobbin tube 26. The remaining features of the embodiment of FIGS. 20 and 21 are identical to those previously described for the embodiment of FIGS. 2 to 11. The apex P described with reference to FIG. 5 could, however, be omitted provided the surfaces 190A and 190B adequately locate the modified thread-catching and severing device or element 178A in its extended position by contact with the chuck casing or outer tubular portion 22 of the chuck member 310*a*.

Seventh Embodiment

Figure 22:
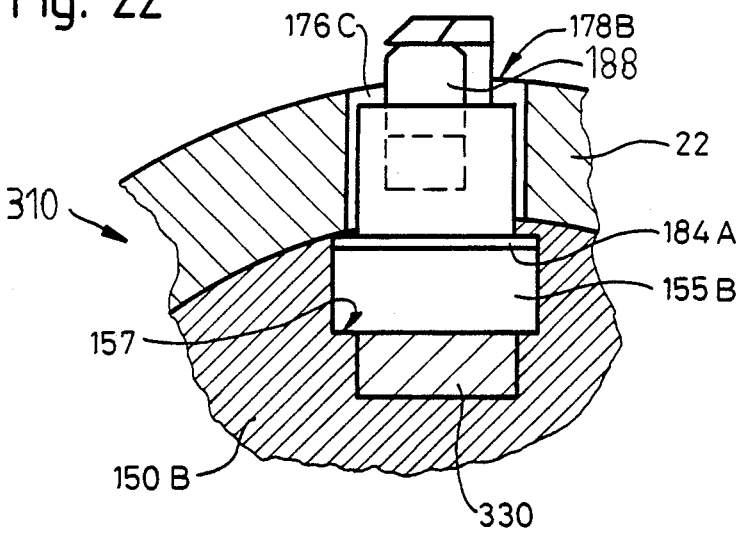
FIGS. 22 and 23 show a modification of the embodiment illustrated in FIGS. 20 and 21.
Figure 23:
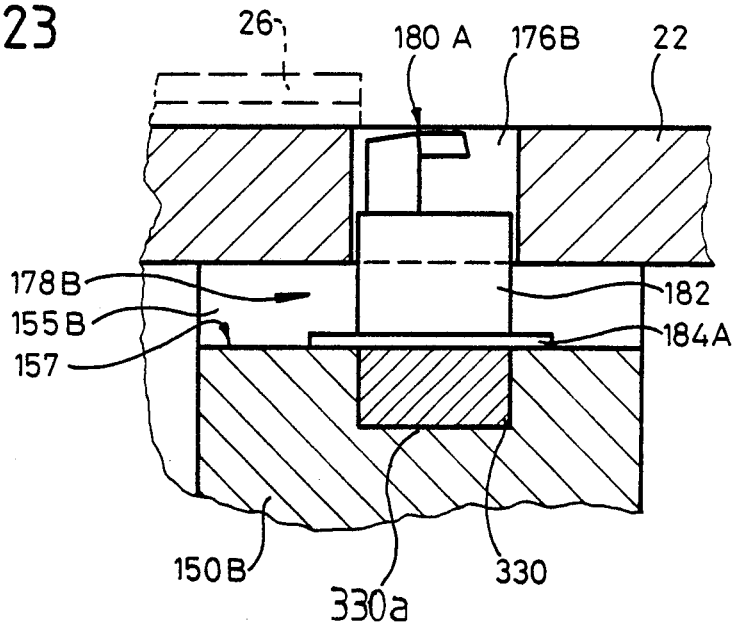

FIGS. 22 and 23 illustrate a modified version of the arrangement shown in FIGS. 20 and 21, FIG. 22 being a view corresponding to FIG. 2 and FIG. 23 being a view corresponding to FIG. 20. Once again, similar parts have been generally indicated by similar reference numerals. The major modification relates to the creation of a biasing force tending to return thread-catching and severing device or element 178B to its retracted position (FIG. 23). As will be described, in this embodiment, the biasing force on each thread-catching and severing device or element 178B is created by a respective permanent magnet and the biasing spring provided in the previous embodiments are eliminated. The foot portion of each element 178B is therefore considerably simplified, as is the task of assembling the unit in the outer tubular portion or chuck portion or outer tubular portion 22.

The bore 176B in the outer tubular portion 22, the head portion 180A of the thread-catching and severing device or element 178B and the intermediate body portion 182 of the thread-catching and severing device or element 178B are as shown in and described with reference to FIGS. 20 and 21. Thus, when the thread-catching and severing device or element 178B is in its extended position (FIG. 22), the relationship of the intermediate body portion 182 to the bore 176B and of the head portion or head 180A to the bobbin tube 26 is as shown in and described with reference to FIG. 21.

However, the relatively heavy and complex foot portion 184 of the previous embodiments is replaced in FIGS. 22 and 23 by a simple plate 184A which projects in all directions beyond the intermediate body portion or body part 182. The slot 155B in support element or member 150B is therefore widened slightly relative to that shown in FIG. 2, in order to take the increased width of the foot portion 184A, and is shallower (radial direction) than the slot in the previous embodiments, corresponding to the decreased (radial) depth of the foot portion 184A.

A suitable blind bore **330*a* is provided in the support member 150B, being axially aligned with the bore 176B in the chuck casing or outer tubular portion 22 of the chuck 310 and opening at one end onto the base surface or structure 157 of the slot 155B. This blind bore 330*a* is filled by a permanent magnet 330 secured in its receiving bore 330*a* by a suitable adhesive so that the outer end face of the magnet is flush with base surface 157**.

The thread-catching and severing device or element 178B (or at least part thereof) is made of a ferromagnetic material so that magnet 330 tends to draw the element 178B radially inwards until foot plate 184A rests on base surface 157 (FIG. 23). Support member 150B is prefereably made of a material having a low magnetic permeability, e.g. aluminum.

The action of centrifugal force on the thread-catching and severing device or element 178B is substantially the same as on the thread-catching and severing device or element 178A of the previous embodiment. When the level of the centrifugal force is sufficient to overcome the magnetic force tending to hold plate 184A in contact with magnet 330, the thread-catching and severing device or element 178B moves radially outwardly until plate 184A engages outer tubular portion 22 (FIG. 22). Element 176B is then in its operative or extended position. The magnet 330 must be arranged so that the element 178B is still subjected to an adequate biasing force (radially inward) even when in the extended position, so that the element 176B returns to the retracted position as the centrifugal force is reduced after completion of winding.

The use of magnetic means to create a biasing force is not of course limited to the illustrated embodiment—it could equally be applied to any of the preceding embodiments, or wherever a returning force is needed to retract an element initially moved out under centrifugal force. It is not essential to provide a permanent magnet—selectively energizable electromagnetic means could be used. A permanent magnet will normally be far simpler, however.

The radially movable thread-clamping element 188 shown in FIGS. 22 and 23 is identical to the element 188 shown in FIGS. 4 and 21. This thread-catching element 188 could, however, be cylindrical e.g. in the form of a pin. The opening receiving this thread-clamping element 188 (whether as actually illustrated or in pin-form) could pass completely through the thread-catching device or element 178 from end to end thereof.

Suitable permanent magnets are available from Maurer Magnetic AG of CH - 8627 Grüningen, Switzerland. By way of example only, a suitable magnet is in disc-form (diameter 12 mm, axial length 6 mm) and is magnetized in the axial direction to give a remanence of 3600 Gauss and a coercive force of 2000 Oersted. The magnet can exert an axially directed force 3N on a ferromagnetic body in contact therewith and an axial force of 1N on the same body at an axial spacing of 1 mm from the magnet.

Reference has already been made to use of the chuck or chuck structure in a winder as shown in the aforementioned U.S. Pat. No. 4,497,540 (European Patent Application 73,930), but the invention is certainly not limited to this type of winder. Alternative multi-chuck winders are shown in U.S. Pat. No. 4,298,171, granted Nov. 3, 1981, listing as the inventors Peter Flückiger et al, and entitled: "WINDING APPARATUS FOR ENDLESS FILAMENTS HAVING AN AUTOMATIC BOBBIN TUBE CHANGER", and U.S. Pat. No. 4,007,884, granted Feb. 15, 1977, listing as the inventors, Schippers et al, and entitled: "WINDING APPARATUS". Single-chuck winders can also include the present invention. The term "cantilever-mounted" is not intended to limit the claims to any specific form of support structure for the chuck 310.

U.S. patent application Ser. No. 723,981 referred to in the introduction as the "co-pending application" corresponds with European Patent Application No. 86,113,104.3, filed Aug. 24, 1986 and British Patent Application No. 8,524,303, filed Oct. 2, 1985, and entitled "CHUCK STRUCTURES".

While there are shown and described present preferred embodiments of the invention, it is to be distinctly understood that the invention is not limited thereto, but may be otherwise variously embodied and practiced within the scope of the following claims. Accordingly,

What we claim is:

1. A chuck structure adapted to be cantilever-mounted for rotation about a longitudinal axis thereof in a winding machine for threads, such as synthetic plastics filament and glass fiber strands, comprising:

a chuck member having a bobbin tube receiving surface;

at least one thread-catching device cooperating with said chuck member;

mounting means associated with said chuck member for dispalceably mounting said at least one thread-catching device inside the chuck structure;

said mounting means being associated with at least one opening extending substantially radially through the chuck structure;

said at least one thread-catching device being displaceably mounted inside the chuck structure by said mounting means and being displaceable generally in radial direction of the chuck structure and at least partially through said at least one opening from a retracted position into an extended position under the action of centrifugal force when the chuck structure is rotated about its longitudinal axis at least at a predetermined operating speed in use;

said mounting means returning said at least one thread-catching device from said extended position towards said retracted position when the chuck structure operates at a rotational speed lower than said predeterminate operating speed of the chuck structure;

said at least one thread-catching device having a head portion which projects radially outwardly from the bobbin tube receiving surface of the chuck member when the at least one thread-catching device is in said extended position;

said head portion of said at least one thread-catching device being located inwardly of said bobbin tube receiving surface when said at least one thread-catching device is in said retracted position; and said head portion including at least a portion of a thread-catching means adapted to receive and clamp a thread to secure the thread for winding into a package when a bobbin tube is received by said bobbin tube receiving surface.

2. The chuck structure as defined in claim 1, further including:

a part carried by the chuck member; and said portion of said thread-catching means cooperating in use with said part carried by the chuck member in order to form said thred-catching means.

3. The chuck structure as defined in claim 1, wherein:

said mounting means serves for mounting said at least one thread-catching device so as to be displaceable generally in radial direction from said retracted position into said extended position under the action of centrifugal force when the chuck structure is rotated about its longitudinal axis at a speed greater than said predeterminate operating speed in use.

4. The chuck structure as defined in claim 1, wherein:

said head portion of said at least one thread-catching device, which is displaceable in said generally radial direction of the rotating chuck structure under the action of centrifugal force such that said head portion projects radially outwardly from said bobbin tube receiving surface, further includes thread severing means.

5. The chuck structure as defined in claim 1, wherein:

said head portion further includes thread guiding means.

6. The chuck structure as defined in claim 1, wherein:

said head portion further includes means for guiding movement of the thread into said thread-catching means generally in axial direction of the chuck structure.

7. The chuck structure as defined in claim 1, further including:

guide means for guiding the radial movement of the at least one thread-catching device between its retracted and extended positions.

8. The chuck structure as defined in claim 1, further including:

biasing means of said mounting means for returning said at least one thread-catching device towards its retracted position.

9. The chuck structure as defined in claim 1, wherein:

the chuck member is adapted to carry at least one bobbin tube; and said mounting means containing force exerting means for exerting a force on the at least one thread-catching device in its extended position and urging the head portion into contact with an axial end face of said at least one bobbin tube which is located adjacent said at least one thread-catching device.

10. The chuck structure as defined in claim 9, wherein:

said force-exerting means define a pivoting system for the at least one thread-catching device, such that, when the at least one thread-catching device is in its extended position, the centrifugal force acting thereon is converted by the pivoting system into a turning moment urging the head portion of the at least one thread one thread-catching device into contact with the axial end face of the at least one bobbin tube.

11. The chuck structure as defined in claim 10, wherein:

said pivoting system includes abutment surfaces, at the chuck member and at the at least one thread-catching device, adapted to engage when the at least one thread-catching device is in its extended position.

12. The chuck structure as defined in claim 11, further including:

biasing means of said mounting means for returning said at least one thread-catching device to said retracted position; and said pivoting system further includes a connection means between the at least one thread-catching device and said biasing means tending to return the at least one thread-catching device to its retracted position.

13. The chuck structure as defined in claim 1, wherein:

said thread-catching means serves for receiving a thread which is moved axially of the chuck member.

14. The chuck structure as defined in claim 1, wherein:

said thread-catching means serves for receiving a thread which is moved of the chuck member.

15. The chuck structure as defined in claim 12, wherein:

said thread-catching means is structured for catching the thread by exerting a clamping action thereat.

16. A chuck structure adapted to be cantilever-mounted for rotation about a longitudinal axis thereof in a winding machine for threads, such as synthetic plastics filament and glass fiber strands, comprising:

a chuck member having a bobbin tube receiving surface;

at least one thread-catching device cooperating with said chuck member;

mounting means associated with said chuck member and for displaceably mounting said at least one thread-catching device;

said mounting means being associated with at least one opening extending substantially radially through the chuck structure;

said at least one thread-catching device being displaceably mounted inside the chuck structure by said mounting means and being displaceable generally in radial direction of the chuck structure and at least partially through said at least one opening from a retracted position into an extended position under the action of centrifugal force when the chuck structure is rotated about its longitudinal axis at least at a predeterminate operating speed;

said at least one thread-catching device having a head portion which projects radially outwardly from the bobbin tube receiving surface of the chuck member when the at least one thread-catching device is in said extended position;

said head portion of said at least one thread-catching device being located inwardly of said bobbin tube receiving surface when said at least one thread-catching device is in said retracted position; and said head portion including thread-catching means adapted to receive and clamp a thread to secure the thread to the chuck member for winding into a package thereon.

17. A chuck structure adapted to be cantilever-mounted for rotation a longitudinal axis thereof in a winding machine for threads, such as synthetic plastics filament and glass fiber strands, comprising:

a chuck member having a bobbin tube receiving surface;

at least one thread-catching device cooperating with said chuck member;

mounting means associated with said chuck member and for displaceably mounting said at least one thread-catching device;

said mounting means being associated with at least one opening extending substantially radially through the chuck structure;

said at least one thread-catching device being displaceably mounted inside the chuck structure by said mounting means and being displaceable generally in radial direction of the chuck structure and at least partially through said at least one opening from a retracted position into an extended position under the action of centrifugal force when the chuck structure is rotated about its longitudinal axis at least at a predeterminate operating speed;

said at least one thread-catching device having a head portion which projects radially outwardly from the bobbin tube receiving surface of the chuck member when the at least one thread-catching device is in said extended position;

said head portion of said at least one thread-catching device being located inwardly of said bobbin tube receiving surface when said at least one thread-catching device is in said retracted position; and said head portion being adapted to co-operate in use with a part carried by the chuck member in order to form a thread-catching and clamping means.

18. The chuck structure as defined in claim 1, wherein:

said chuck member comprises a tubular portion provided with said at least one opening through which said at least one thread-catching device projects in said extended position.

* * * * *

UNITED STATES PATENT AND TRADEMARK OFFICE

CERTIFICATE OF CORRECTION

PATENT NO. : 4,817,896

DATED : April 4, 1989

INVENTOR(S) : PETER BUSENHART et al

It is certified that error appears in the above-identified patent and that said Letters Patent is hereby corrected as shown below:

Column 1, line 29, before "the" (first occurrence) please delete "long" and insert --along--

Column 2, line 28, after "structure" please delete "o" and insert --of--

Column 3, line 63, after "FIG.16;" please delete "elevation, respectively, and illustrate yet another embodiment,"

Column 3, line 66, before "thread-catching" please insert --elevation, respectively, and illustrate yet another embodiment of--

Column 8, line 66, after "severing" please insert --device 178 moves towards the condition illustrated in FIG. 10 through increased flexing of the spring arm 200--

Column 8, line 67, please delete "178 moves towards the condition illustrated in FIG."

Column 8, line 68, please delete "10 through increased flexing of the spring arm 200"

Column 13, line 18, after "joined" please insert --by--

UNITED STATES PATENT AND TRADEMARK OFFICE

CERTIFICATE OF CORRECTION

PATENT NO. : 4,817,896

DATED : April 4, 1989

INVENTOR(S) : PETER BUSENHART et al

It is certified that error appears in the above-identified patent and that said Letters Patent is hereby corrected as shown below:

Column 17, line 29, after "in" please insert --dash-dotted line in Figure 16. Reduction of centrifugal force"

Column 23, line 13, after "said" please delete "thred-catching" and insert --thread-catching--

Column 23, line 66, after "least" please delete "one thread"

Column 24, line 26, after "moved" please insert --radially--

Column 24, line 68, after "rotation" please insert --about--

Signed and Sealed this

Twentieth Day of March, 1990

*Attest:*

JEFFREY M. SAMUELS

*Attesting Officer*

*Acting Commissioner of Patents and Trademarks*